US009305430B2

(12) United States Patent
Inamura

(10) Patent No.: US 9,305,430 B2
(45) Date of Patent: Apr. 5, 2016

(54) GAMING MACHINE WITH PROGRESSIVE FEATURE FOR PAYLINES AND PLAYING METHOD THEREOF

(75) Inventor: Yukinori Inamura, Koto-ku (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 1878 days.

(21) Appl. No.: 12/207,000

(22) Filed: Sep. 9, 2008

(65) Prior Publication Data

US 2009/0247263 A1 Oct. 1, 2009

Related U.S. Application Data

(60) Provisional application No. 61/039,997, filed on Mar. 27, 2008.

(51) Int. Cl.
*A63F 9/24* (2006.01)
*G07F 17/32* (2006.01)
*G07F 17/34* (2006.01)

(52) U.S. Cl.
CPC ..... *G07F 17/3258* (2013.01); *G07F 17/34* (2013.01)

(58) Field of Classification Search
USPC ..... 463/20, 30, 40, 42, 21, 32
See application file for complete search history.

(56) References Cited

U.S. PATENT DOCUMENTS 6,926,607 B2 * 8/2005 Slomiany et al. ..... 463/20
7,059,965 B2 * 6/2006 Jackson ..... 463/16
7,533,885 B2 * 5/2009 Nicely et al. ..... 273/142 R
2002/0025843 A1 2/2002 Bryant
2004/0023716 A1 * 2/2004 Gauselmann ..... 463/26
2006/0172792 A1 * 8/2006 Vancura ..... 463/16
2008/0113696 A1 * 5/2008 Owen et al. ..... 463/1
2009/0069087 A1 * 3/2009 Kelly ..... G07F 17/3267 463/37
2009/0098932 A1 * 4/2009 Longway ..... 463/22

OTHER PUBLICATIONS

U.S. Appl. No. 12/207,829, filed Sep. 10, 2008, Inamura.
U.S. Appl. No. 12/207,969, filed Sep. 10, 2008, Inamura.
U.S. Appl. No. 12/411,439, filed Mar. 26, 2009, Inamura.

* cited by examiner

*Primary Examiner* — Paul A D'Agostino
*Assistant Examiner* — Brandon Gray
(74) *Attorney, Agent, or Firm* — Lex IP Meister, PLLC

(57) ABSTRACT

A slot machine executes a slot game by rearranging symbols that are arranged in multiple partitioned regions in a matrix including first to fifth columns and first to third rows. There are multiple paylines in these partitioned regions in the matrix. A player selects and specifies some of these paylines to be bet with game media. By betting the game media on each of the specified paylines, those paylines are activated in the slot game. When the rearranged symbols form a winning combination on any of the activated paylines, the player receives an award. Moreover, the slot machine performs a process to decide an award content for a progressive bonus along execution of the slot game in which the player bets the game media on all the paylines or a predetermined number or more of the paylines. The process to decide the award content for the progressive bonus may also be performed when the slot games in which the player bets the game media on all the paylines or the predetermined number or more of the paylines are executed continuously a predetermined number of times.

24 Claims, 20 Drawing Sheets

FIG. 3

| | COLUMN 1 | COLUMN 2 | COLUMN 3 | COLUMN 4 | COLUMN 5 |
|---|---|---|---|---|---|
| ROW 1 | q11 | q21 | q31 | q41 | q51 |
| ROW 2 | q12 | q22 | q32 | q42 | q52 |
| ROW 3 | q13 | q23 | q33 | q43 | q53 |

FIG. 14

PAYOUT TABLE

| ALL PAYS ON PAYLINE | 1ST Credit | 2ND Credit | 3RD Credit |
|---|---|---|---|
| DOUBLE DOUBLE DOUBLE DOUBLE DOUBLE | 800 | 1600 | 2400 |
| BAR BAR BAR BAR BAR BAR BAR BAR BAR BAR BAR BAR BAR BAR BAR | 60 | 120 | 180 |
| BAR BAR BAR BAR BAR BAR BAR BAR BAR BAR | 30 | 60 | 90 |
| | 20 | 40 | 60 |
| BAR BAR BAR BAR BAR | 15 | 30 | 45 |
| ANY BAR ANY BAR ANY BAR ANY BAR ANY BAR | 5 | 10 | 15 |
| ANY 2 | 5 | 10 | 15 |
| ANY 1 | 2 | 4 | 6 |

GAMING MACHINE WITH PROGRESSIVE FEATURE FOR PAYLINES AND PLAYING METHOD THEREOF

CROSS REFERENCE TO RELATED APPLICATIONS

This application claims priority to U.S. provisional patent application Ser. No. 61/039,997 filed on Mar. 27, 2008, and which is incorporated by reference herein for all purposes.

BACKGROUND OF THE INVENTION

1. Field of the Invention

The present invention relates to a gaming machine with a progressive feature for paylines and a playing method thereof.

2. Description of Related Art

U.S. Pat. No. 6,926,607 and US Patent Application Publication No. 2002/0025843 disclose multiline type slot machines with which a player can select a payline for making a bet out of multiple paylines.

In such a multiline type slot machine, a payline on which the player makes a bet is activated, and the player can receive a payout when a winning combination is formed on the activated payline. Therefore, the player cannot receive any payout if a winning combination is formed on a payline on which the player does not make a bet.

With this slot machine, by making a full-line bet in which a certain total amount of bet is dispersedly made on all paylines, the player can surely receive a payout when a winning combination is formed on any of the paylines. Instead, in this case, the player can naturally receive only a smaller payout than another player, who makes the same total amount of bet by focusing only a single line or a few paylines, can receive when a winning combination is formed on the activated payline.

SUMMARY OF THE INVENTION

An object of the present invention is to provide a gaming machine and a playing method thereof, which have higher entertainment properties by offering a chance to get a large award to a player who dispersedly makes bets on many paylines.

A first aspect of the present invention is a gaming machine comprising: a display configured to display a unit game causing a plurality of arranged symbols to be rearranged; a button configured to specify a payline for bet for each unit game, out of a plurality of paylines set on the display; a counter configured to count a counted value of a progressive bonus; and a controller configured to: (a) decide whether or not to provide an award for the progressive bonus in a unit game in which all the paylines are specified for bet by an operation of the button by a player; and (b) upon decision of providing the award for the progressive bonus, provide at least some of the counted value to the player as the award for the progressive bonus in the unit game in which all the paylines are specified for bet.

A second aspect of the present invention is a gaming machine comprising: a display configured to display a unit game causing a plurality of arranged symbols to be rearranged; a button configured to specify a payline for bet for each unit game, out of a plurality of paylines set on the display; a counter configured to count a counted value of a progressive bonus; and a controller configured to: (a) judge whether or not the unit game is a unit game in which all the paylines are specified for bet by an operation of the button by a player; (b) upon judgment that the unit game is not the unit game in which all the paylines are specified for bet, prevent a process of deciding a content of an award for the progressive bonus; (c) upon judgment that the unit game is the unit game in which all the paylines are specified for bet, execute the process of deciding the content of the award for the progressive bonus; and (d) provide at least some of the counted value to the player as the award for the progressive bonus in the unit game in which all the paylines are specified for bet, in accordance with the decided content of the award for the progressive bonus.

A third aspect of the present invention is a gaming machine comprising: a display configured to display a unit game causing a plurality of arranged symbols to be rearranged; a button configured to specify a payline for bet for each unit game, out of a plurality of paylines set on the display; a counter configured to count a counted value of a progressive bonus; and a controller configured to: (a) decide whether or not to provide an award for the progressive bonus in a unit game in which a predetermined number or more of the paylines are specified for bet by an operation of the button by a player; and (b) upon decision of providing the award for the progressive bonus, provide at least some of the counted value to the player as the award for the progressive bonus in the unit game in which the predetermined number or more of the paylines are specified for bet.

A fourth aspect of the present invention is a gaming machine comprising: a display configured to display a unit game causing a plurality of arranged symbols to be rearranged; a button configured to specify a payline for bet for each unit game, out of a plurality of paylines set on the display; a counter configured to count a counted value of a progressive bonus; and a controller configured to: (a) judge whether or not the unit game is a unit game in which a predetermined number or more of the paylines are specified for bet by an operation of the button by a player; (b) upon judgment that the unit game is not the unit game in which the predetermined number or more of the paylines are specified for bet, prevent a process of deciding a content of an award for the progressive bonus; (c) upon judgment that the unit game is the unit game in which the predetermined number or more of the paylines are specified for bet, execute the process of deciding the content of the award for the progressive bonus; and (d) provide at least some of the counted value to the player as the award for the progressive bonus in the unit game in which the predetermined number or more of the paylines are specified for bet, in accordance with the decided content of the award for the progressive bonus.

A fifth aspect of the present invention is a method of playing a gaming machine configured to specify, by an operation of a button by a player, a payline for bet for each of unit games causing a plurality of arranged symbols to be rearranged, out of a plurality of paylines set on a display configured to display the unit games, the method comprising: deciding whether or not to provide an award for a progressive bonus depending on a counted value counted by a counter, in a unit game in which all the paylines are specified for bet by the operation of the button by the player; and upon decision of providing the award for the progressive bonus, providing at least some of the counted value to the player as the award for the progressive bonus in the unit game in which all the paylines are specified for bet.

A sixth aspect of the present invention is a method of playing a gaming machine configured to specify, by an operation of a button by a player, a payline for bet for each of unit games causing a plurality of arranged symbols to be rearranged, out of a plurality of paylines set on a display configured to display the unit games, the method comprising: judging whether or not the unit game is a unit game in which all the paylines are specified for bet by the operation of the button by a player; upon judgment that the unit game is not the unit game in which all the paylines are specified for bet, preventing a process of deciding a content of an award for a progressive bonus depending on a counted value counted by a counter; upon judgment that the unit game is the unit game in which all the paylines are specified for bet, executing the process of deciding the content of the award for the progressive bonus; and providing at least some of the counted value to the player as the award for the progressive bonus in the unit game in which all the paylines are specified for bet, in accordance with the decided content of the award for the progressive bonus.

A seventh aspect of the present invention is a method of playing a gaming machine configured to specify, by an operation of a button by a player, a payline for bet for each of unit games causing a plurality of arranged symbols to be rearranged, out of a plurality of paylines set on a display configured to display the unit games, the method comprising: deciding whether or not to provide an award for a progressive bonus depending on a counted value counted by a counter, in a unit game in which a predetermined number or more of the paylines are specified for bet by the operation of the button by the player; and upon decision of providing the award for the progressive bonus, providing at least some of the counted value to the player as the award for the progressive bonus in the unit game in which the predetermined number or more of the paylines are specified for bet.

An eighth aspect of the present invention is a method of playing a gaming machine configured to specify, by an operation of a button by a player, a payline for bet for each of unit games causing a plurality of arranged symbols to be rearranged, out of a plurality of paylines set on a display configured to display the unit games, the method comprising: judging whether or not the unit game is a unit game in which a predetermined number or more of the paylines are specified for bet by the operation of the button by the player; upon judgment that the unit game is not the unit game in which the predetermined number or more of the paylines are specified for bet, preventing a process of deciding a content of an award for a progressive bonus depending on a counted value counted by a counter; upon judgment that the unit game is the unit game in which the predetermined number or more of the paylines are specified for bet, executing the process of deciding the content of the award for the progressive bonus; and providing at least some of the counted value to the player as the award for the progressive bonus in the unit game in which the predetermined number or more of the paylines are specified for bet, in accordance with the decided content of the award for the progressive bonus.

BRIEF DESCRIPTION OF THE DRAWINGS

FIG. 3 is a view for explaining partitioned regions in a matrix provided on a display of the slot machine according to the embodiment of the present invention.

FIG. 14 is a payout table showing relations between winning combinations and payouts in a slot game with the slot machine according to the first embodiment of the present invention.

DETAILED DESCRIPTION OF THE EMBODIMENTS

Figure 1:
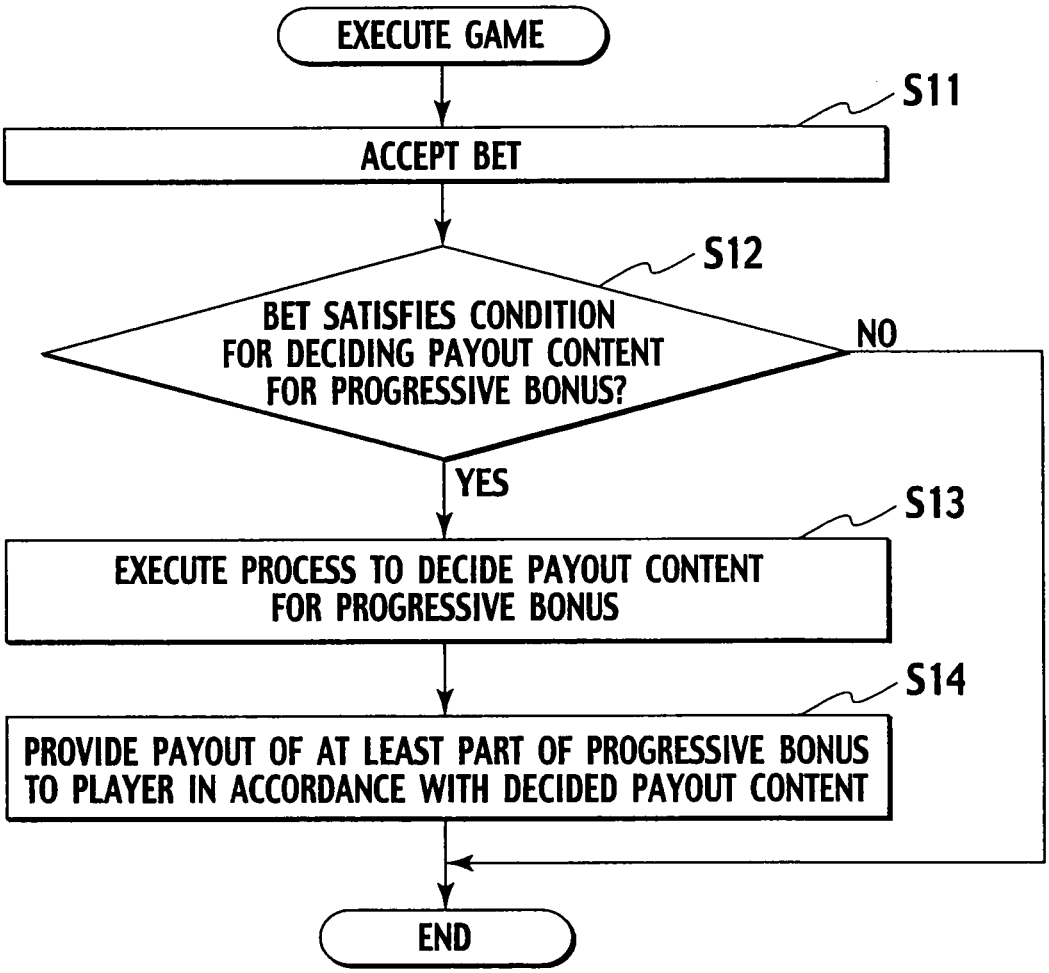
FIG. 1 is a flowchart schematically showing procedures of a slot machine according to an embodiment of the present invention.

Now, outlines of operations of a slot machine and a playing method thereof according to an embodiment of the present invention will be described below with reference to a flowchart shown in FIG. 1, a perspective view of the slot machine shown in FIG. 2, a view for explaining partitioned regions for rearranging symbols of the slot machine shown in FIG. 3, and views for explaining paylines settable in the partitioned regions shown in FIG. 4 to FIG. 7. Here, the slot machine represents an example of a gaming machine of the present invention.

In the slot machine of this embodiment and the playing method thereof, a player can execute one slot game session (a unit game) by making a bet of game media. In the slot game, symbols are rearranged in 15 partitioned regions q11 to q53 provided on a display 16 of a slot machine 10 shown in FIG. 2. As shown in FIG. 3, these partitioned regions q11 to q53 are arranged in a matrix including first to fifth columns and first to third rows.

In these partitioned regions q11 to q53 in the matrix, there are 21 paylines in total as shown in FIG. 4 to FIG. 7. The player can select and specify (designate) paylines on which the game media is bet out of these 21 paylines. By making a bet of the game media on each of the specified paylines, those paylines are activated in the slot game session. When a winning combination is formed on any of the activated paylines by the rearranged symbols, the player can receive a payout (an award). Here, the player can specify the paylines on which the game media is bet by operating a selection button 19 and a confirmation button 20 of the slot machine 10 shown in FIG. 2.

Figure 2:
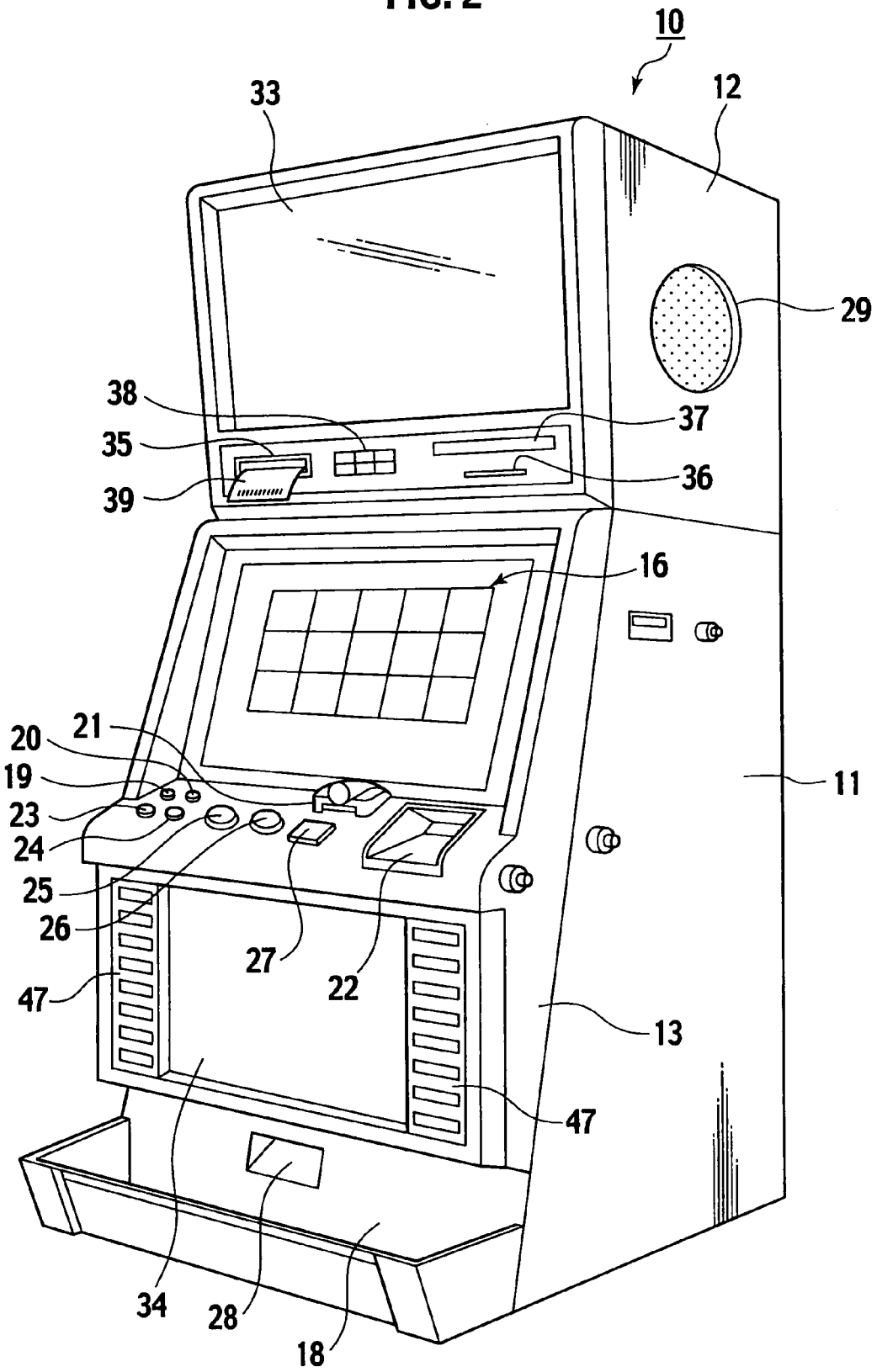
FIG. 2 is a perspective view of the slot machine according to the embodiment of the present invention.
Figure 4:
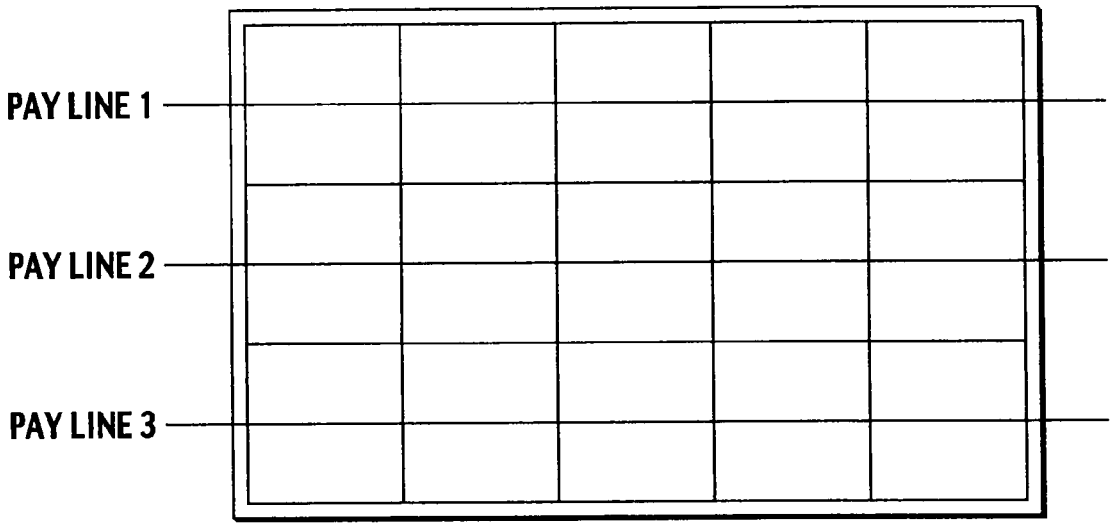
FIG. 4 is a view for explaining paylines settable in the partitioned regions in the matrix provided on the display of the slot machine according to the embodiment of the present invention.
Figure 5:
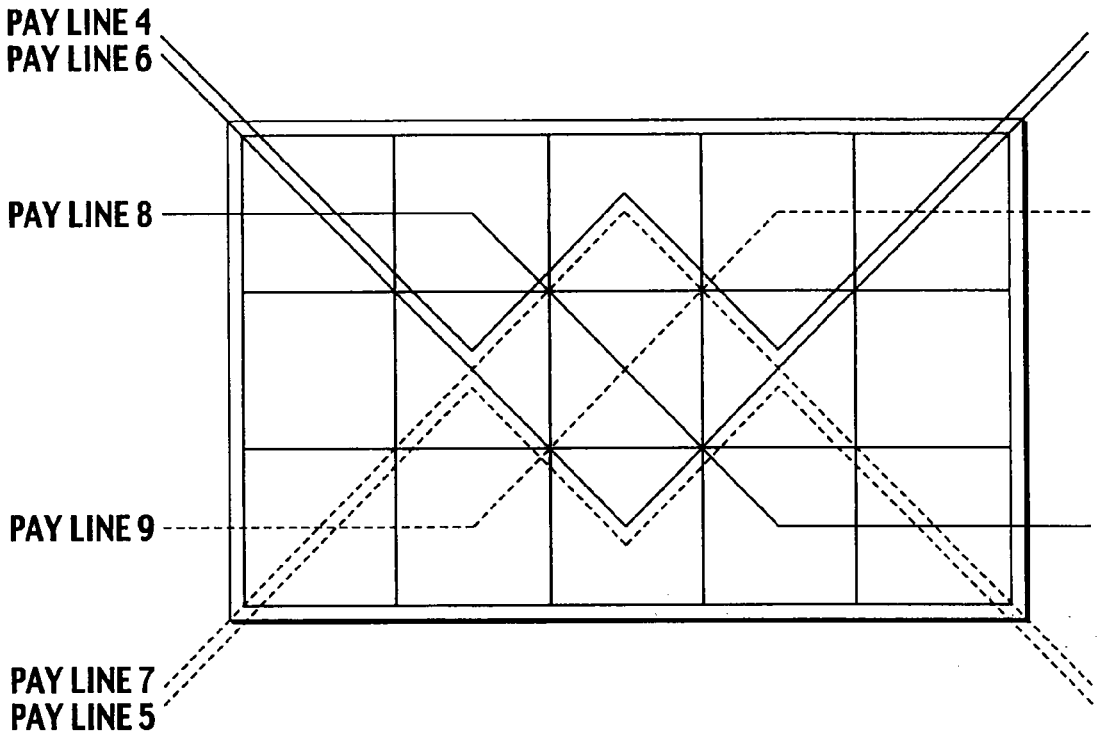
FIG. 5 is a view for explaining other paylines settable in the partitioned regions in the matrix provided on the display of the slot machine according to the embodiment of the present invention.
Figure 6:
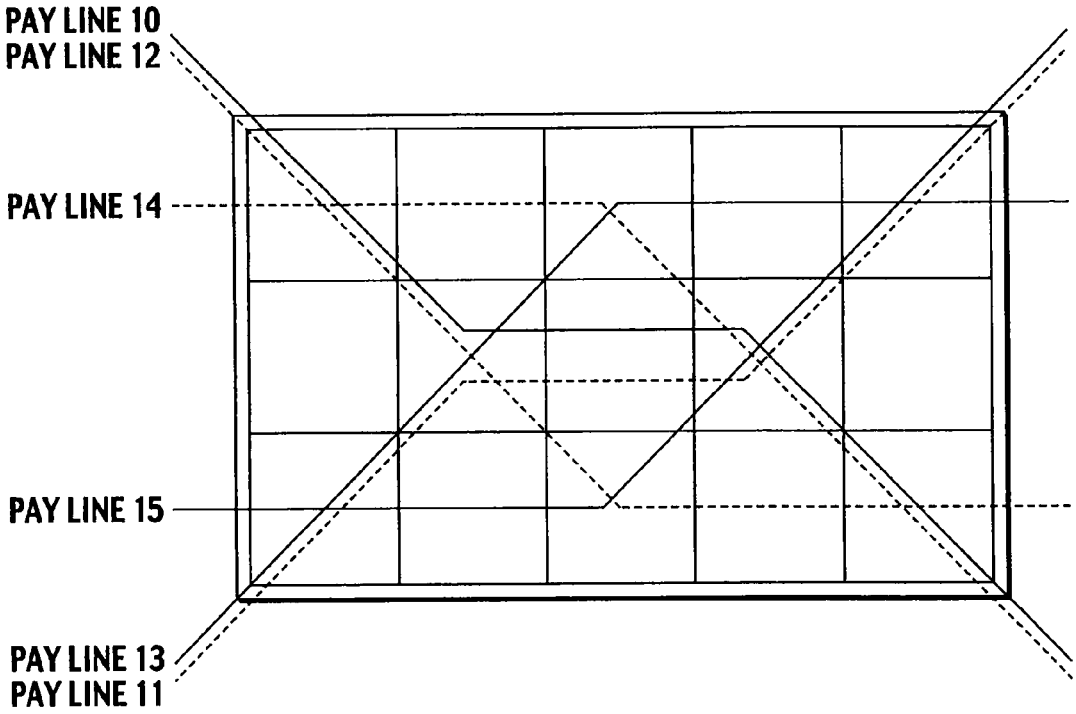
FIG. 6 is a view for explaining other paylines settable in the partitioned regions in the matrix provided on the display of the slot machine according to the embodiment of the present invention.
Figure 7:
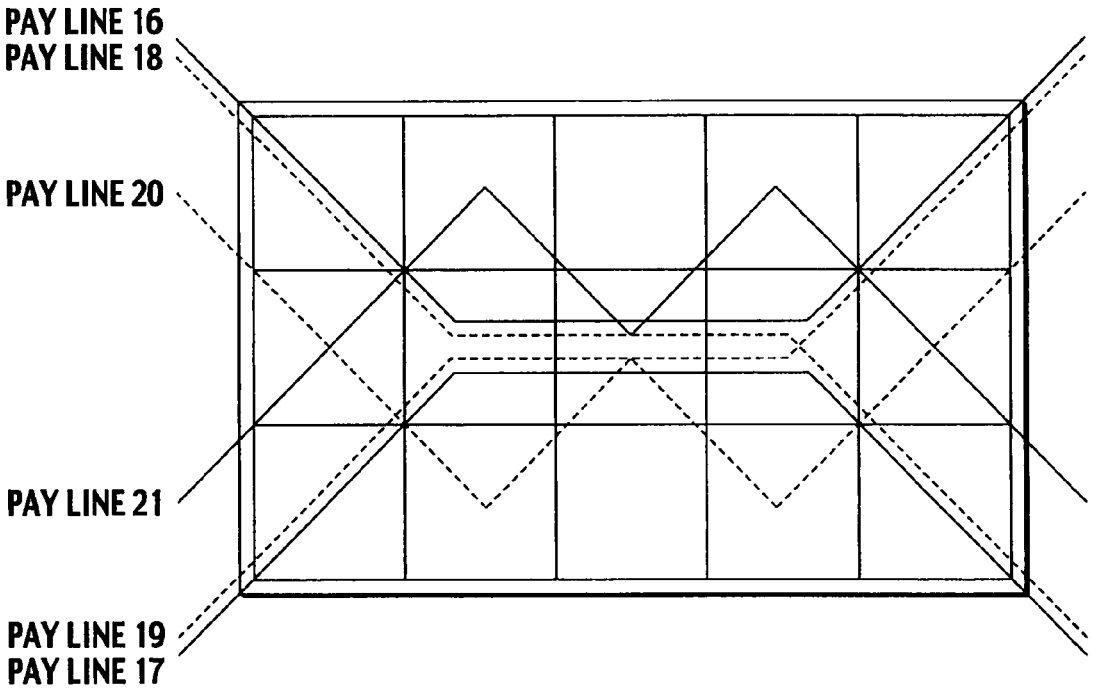
FIG. 7 is a view for explaining other paylines settable in the partitioned regions in the matrix provided on the display of the slot machine according to the embodiment of the present invention.

The player can make the bet of the game media on the specified paylines by operating a MAXBET button 24, a BET button 25 or a spin repeat bet button 26 of the slot machine 10 shown in FIG. 2. To be more precise, the player can make the bet of the game media on the specified paylines by allocating a designated amount of restricted credits, which are digitalized and memorized in the slot machine 10 and rendered continuously usable as the game media until cashing, to the bet by operating any of the above-described buttons 24, 25, and 26.

Here, the player can cause the slot machine 10 to memorize the above-described credits by inserting medals or coins that represent cashable credits, which can be cashed, to the slot machine 10.

In the following description, a unit of the game media that the player can use to make a bet with the above-described cashable credits and the restricted credits will be referred to as a "credit".

Moreover, in the slot machine 10 of this embodiment and the playing method thereof, when a condition to be described later is satisfied, a decision is made as to whether or not a payout (an award) for a progressive bonus is to be executed. As will be described later, this progressive bonus may be updated or accumulated as needed in the course of slot games. To be more precise, the progressive bonus may be updated or accumulated every time the player makes a bet on a predetermined number or more of the paylines, or on all the paylines in the slot game.

Then, the slot machine 10 of this embodiment firstly accepts the player's bet on one slot game session which is about to be executed (step S11). In this bet acceptance, the slot machine 10 accepts specification of the paylines to be bet and inputs of an amount of the bet for each of the paylines thus specified.

Subsequently, the slot machine 10 judges whether or not the accepted bet satisfies a condition for determining a payout content (a content of an award) of the progressive bonus (step S12). This condition may be satisfied by a fact that the accepted bet is a full-line bet which is targeted for all the paylines. Alternatively, this condition may be satisfied if the accepted bet is targeted for a predetermined number or more of the paylines.

Thereafter, when the slot machine 10 judges that the accepted bet satisfies any of the above-mentioned conditions (YES in step S12), the slot machine 10 executes a process to decide the payout content for the progressive bonus (step S13). The decision concerning the payout content for the progressive bonus in this process also includes a decision to set the payout equal to zero, i.e. not to provide any payout for the progressive bonus.

After the process in step S13, the slot machine 10 performs a process to pay out to the player at least some of a counted value of the progressive bonus counted by a counter as the payout for the progressive bonus in the slot game accepting the bet that satisfies any of the above-described condition in accordance with the decided payout content for the progressive bonus (step S14).

Here, when the slot machine 10 judges that the accepted bet does not satisfy any of the above-described conditions (NO in step S12), the slot machine 10 does not execute the process for deciding the payout content for the progressive bonus.

In other words, step S12 and step S13 out of the sequence from step S11 to step S14 involve, as a whole, the execution of the process for deciding whether or not to execute the payout for the progressive bonus in the slot game in the case of either making the full-line bet or making the bet on the predetermined number or more of the paylines.

According to the slot machine 10 of this embodiment and the playing method thereof, the process to decide the payout content for the progressive bonus is executed when the content of the bet made by the player satisfies the condition for deciding the payout content for the progressive bonus. To be more precise, the process to decide the payout content for the progressive bonus is executed when the player makes the full-line bet or the bet targeted for the predetermined number or more of the paylines.

Therefore, by dispersing the bet on all the paylines or the predetermined number or more of the paylines, the payout to be received by the player is reduced when a winning combination is formed on any of these paylines whereas the player has a chance to receive the progressive bonus with a larger payout.

For this reason, it is possible to reduce the anxiety of the player that the amount of the payout may become less at the time of formation of the winning combination by dispersing the bet on all the paylines or the predetermined number or more of the paylines, and thereby to provide the gaming machine and the playing method thereof having higher entertainment properties.

Next, a configuration of the slot machine 10 according to this embodiment of the present invention will be described in detail. As shown in FIG. 2, the slot machine 10 of this embodiment includes a cabinet 11, a top box provided on an upper side of the cabinet 11, and a main door 13. The cabinet 11 is provided with a display 16 on a face opposed to the player. Moreover, various constituent members including a controller 40 (see FIG. 8) configured to electrically control the slot machine 10 and a hopper 44 (see FIG. 8) configured to control insertion, storage, and payouts of medals are disposed inside the cabinet 11.

This embodiment describes an example of making a bet necessary for executing a game by using medals. However, in addition to the medals, it is possible to employ other cashable credits including coins and tokens. Moreover, it is also possible to make a bet on a game by using the restricted credits typically in the form of electronic money or electronic value information corresponding thereto, which are digitalized and memorized in the slot machine 10 and rendered continuously usable as the game media until cashing. The bet on a game using these game media will be also simply referred to as a bet below.

The main door 13 is openably and closably fitted to the cabinet 11, and the display 16 is provided substantially in the center of this main door 13. As will be described later, the display 16 is adapted to display images concerning various games including slot games. Symbols disposed in the 15 partitioned regions q11 to q53 arranged in the matrix including the first to fifth columns and the first to third rows as shown in FIG. 3 are changed and then rearranged in a slot game.

As shown in FIG. 4 to FIG. 7, there are 21 paylines in total in the partitioned regions q11 to q53. The player can select and specify paylines to be bet out of these 21 paylines. By making a bet on the specified paylines, those paylines are activated in the slot game.

Moreover, when any of winning combinations (see FIG. 14) is formed on any of the activated paylines by the symbols rearranged in the respective partitioned regions q11 to q53, the player can receive the payout corresponding to the content of the winning combination. Here, in this embodiment, the payout corresponding to the winning combination thus formed is carried out in the form of an increase in the memorized number of the restricted credits memorized in the slot machine 10 as will be described later. The memorized number of the restricted credits is displayed on the display 16 as will be described later.

As shown in FIG. 2, a medal insertion slot 21 and a bill validator 22 are provided below the display 16. The medal insertion slot 21 and the bill validator 22 are used when the player makes a bet to play the slot game. The medal insertion slot 21 is for inserting medals and the bill validator 22 validates whether each bill is authentic, and accepts authentic bills. Moreover, various operation buttons are provided in the vicinity of the medal insertion slot 21 and the bill validator 22.

The selection button 19, the confirmation button 20, a payout button 23, the MAXBET button 24, the BET button 25, the spin repeat bet button 26, a MAXBET switch 24, and a start button 27 are provided as the operation buttons.

The selection button 19 is a button for specifying the paylines for making a bet. The paylines targeted for specification are switched every time the selection button 19 is pressed. The confirmation button 20 is a button for confirming the paylines targeted for specification, which are switched by the operation of the selection button 19, as the activated paylines by making the bet. At the point of pressing the confirmation button 20, the paylines specified by the operation of the selection button 19 are formally specified as the activated paylines for making the bet.

The BET button 25 is a button for determining the number of the restricted credits to be bet on the slot game executed on the display 16 when making the bet by using the restricted credits. One credit is bet on the slot game every time the BET button 25 is pressed.

The MAXBET button 24 is a button for making a bet, in a single operation, in the maximum amount that the player can make a bet in one slot game session. Here, the maximum amount of the bet permitted in one slot game session may be changed by an operation of an administrator.

The spin repeat bet button 26 is a button to be operated by the player when the paylines to be bet and the amount of the bet in the current game are set to the same contents as the previous game. By operating this spin repeat bet button 26, it is possible to make the bet on the same paylines and in the same number of credits as those in the previous game while eliminating burdens to operate the selection button 19 and the confirmation button 20 again for specifying the paylines to be bet in the current slot game and to operate the MAXBET button 24 or the BET button 25 again to set the amount of the wager to be bet on the specified paylines.

The start button 27 is a button for starting the slot game on the display 16 after the bet is made. When the start button 27 is pressed after specifying the paylines and making the bet on the specified paylines in the current game, symbol varying and displaying is carried out in each of the partitioned regions q11 to q53 on the display 16 and the symbols are eventually rearranged.

The payout button 23 is a button for providing the medals equivalent to the memorized number of the restricted credits displayed on the display 16. The medals to be provided are discharged from a medal payout opening 28 provided at a lower part on the front face of the main door 13. The discharged medals are pooled in a medal tray 18.

A foot display 34 is provided at a lower part on the front face of the main door 13 and is configured to display various images concerning the slot game. The images include characters of the slot games executed by this slot machine 10, for example.

Lamps 47 are provided on both sides of the foot display 34 and are configured to emit light on the basis of a preset light emission pattern. The above-described medal payout opening 28 is provided below the foot display 34.

An upper display 33 is provided on a front face of the top box 12. Amounts of medals to be provided corresponding to combinations of the symbols and other effect images are displayed on this upper display 33.

Meanwhile, the top box 12 is provided with a speaker 29. A ticket printer 35, a card reader 36, a data display 37, and a keypad 38 are provided on a lower side of the upper display 33. The ticket printer 35 is configured to print a ticket with a bar code encoding respective data including the amount of credits, date and time, an identification number of the slot machine 10, and the like and to output the ticket as a bar coded ticket 39.

The player is able to allow another slot machine to read the bar coded ticket 39 and to play games with that slot machine or to exchange the bar coded ticket 39 with money bills and the like at a predetermined location in a gaming facility (such as a cashier in a casino).

The card reader 36 allows insertion of a smart card and is configured to read data out of the inserted smart card and to write data into the smart card. The smart card is a card carried by the player, which stores data for identifying the player, data concerning a history of games played by the player, and so forth. Here, it is also possible to change an upper limit of the bet executable in one slot game session on the basis of the data read out of the smart card with the card reader 36. Such a change in the upper limit of the bet is beneficial to a high roller player.

Figure 8:
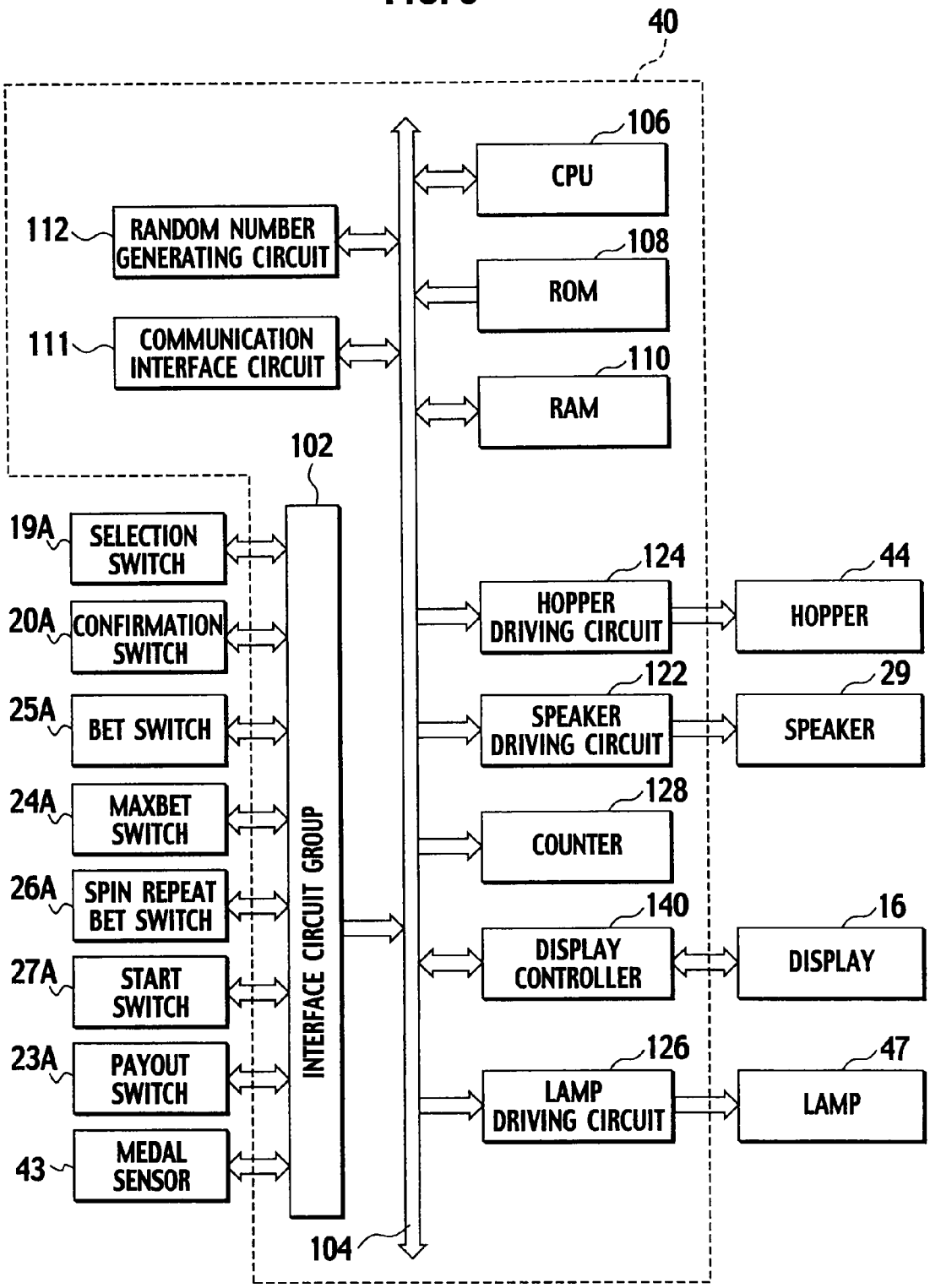
FIG. 8 is a block diagram showing a control circuit of the slot machine according to the embodiment of the present invention.

FIG. 8 is a block diagram showing a controller 40 included in the slot machine 10 of this embodiment and electrical configurations of various devices to be connected to this controller 40. The controller 40 of the slot machine 10 shown in FIG. 8 is a microcomputer which includes: an interface circuit group 102; an input-output bus 104; a CPU (central processing unit) 106; a ROM (read-only memory) 108; a RAM (random access memory) 110; a communication interface circuit 111; a random number generating circuit 112; a speaker driving circuit 122; a hopper driving circuit 124; a counter 128; and a display controller 140.

The interface circuit group 102 is connected to the input-output bus 104 and this input-output bus 104 inputs and outputs data signals and address signals to and from the CPU 106.

A start switch 27A for detecting an operation of the start button 27 is connected to the interface circuit group 102. A start signal outputted from this start switch 27A is converted into a certain signal by the interface circuit group 102 and is then transmitted to the CPU 106 through the input-output bus 104.

A selection switch 19A for detecting an operation of the selection button 19, a confirmation switch 20A for detecting an operation of the confirmation switch 20, a BET switch 25A for detecting an operation of the BET button 25, a MAXBET switch 24A for detecting an operation of the MAXBET button 24, a spin repeat bet switch 26A for detecting an operation of the spin repeat bet switch 26, and a payout switch 23 for detecting an operation of the payout button 23 are connected to the interface circuit group 102. Moreover, respective switching signals outputted from these switches 19A, 20A, 25A, 24A, 26A, and 23A are supplied to the interface circuit group 102, then converted into certain signals by this interface circuit group 102, and then transmitted to the CPU 106 through the input-output bus 104.

In addition, a medal sensor 43 is connected to the interface circuit group 102. The medal sensor 43 is a sensor for detecting medals inserted to the medal insertion slot 21, and is provided at a medal insertion region of the medal insertion slot 21. A detection signal outputted from this medal sensor 43 is supplied to the interface circuit group 102, then converted into a certain signal by this interface circuit group 102, and then transmitted to the CPU 106 through the input-output bus 104.

The ROM 108 for storing system programs and the RAM 110 for saving various data are connected to the input-output bus 104. Moreover, the random number generating circuit 112, the communication interface circuit 111, the display controller 140, the hopper driving circuit 124, the speaker driving circuit 122, a lamp driving circuit 126, and the counter 128 are connected to the input-output bus 104.

Triggered by acceptance of a starting operation of a game in the form of a signal input from the start switch 27A associated with the operation of the start button 27 by the player, the CPU 106 reads out a game execution program and executes a slot game. The game execution program is a program for executing the slot game on the display 16 through the display controller 140.

Specifically, the game execution program is programmed to scroll the symbols in all the partitioned regions q11 to q53 (see FIG. 3), then to stop and to rearrange the symbols therein. Moreover, the game execution program is programmed to execute the slot game in which a payout is generated when the rearranged symbols forms a winning combination on the active payline having a bet made thereon.

The communication interface circuit 111 is connected to a hall server, for example, and transmits data such as a play history executed by the slot machine 10, and the like to the hall server. Meanwhile, the communication interface circuit 111 receives various data transmitted from the hall server.

The random number generating circuit 112 generates a random number for determining whether or not to form the winning combination on any of the active paylines, having the bet made thereon, in the slot game to be executed on the display 16.

The counter 128 includes a function to count resources for the progressive bonus. The resources for the progressive bonus counted by this counter 128 are accumulated according to a some of the amount of the bet when the player makes the bet on one slot game session that has the content to satisfy the predetermined condition. Note that the counter 128 may also be provided inside the RAM 110.

The speaker driving circuit 122 outputs voice data to the speaker 29. Specifically, the CPU 106 reads the voice data stored in the ROM 108 and transmits the voice data to the speaker driving circuit 122 through the input-output bus 104. In this way, predetermined sound effects are outputted from the speaker 29.

The hopper driving circuit 124 outputs a payout signal to the hopper 44 when a payout becomes effective. Specifically, when the payout signal is inputted from the payout switch 23A as a result of an operation of the payout button 23 by the player, the CPU 106 outputs a driving signal to the hopper driving circuit 124 through the input-output bus 104. Accordingly, the hopper 44 provides the medals equivalent to the remaining amount of the restricted credits at that point stored in a predetermined memory region of the RAM 110 and displayed on display 16.

The display controller 140 performs display control for executing the slot game on the display 16. Specifically, the CPU 106 generates image display instruction signals corresponding to a state of the slot game and an outcome of the slot game and outputs the image display instruction signals to the display controller 140 through the input-output bus 104. When the image display instruction signals outputted from the CPU 106 are inputted to the display controller 140, the display controller 140 generates driving signals for driving the display 16 on the basis of the image display instruction signals and outputs the generated driving signals to the display 16. In this way, various images such as effect images, and game explanation images are displayed on the display 16.

Next, procedures for executing a game with the slot machine 10 as a gaming machine according to a first embodiment of the present invention will be described with reference to flowcharts shown in FIG. 9 to FIG. 13.

Figure 9:
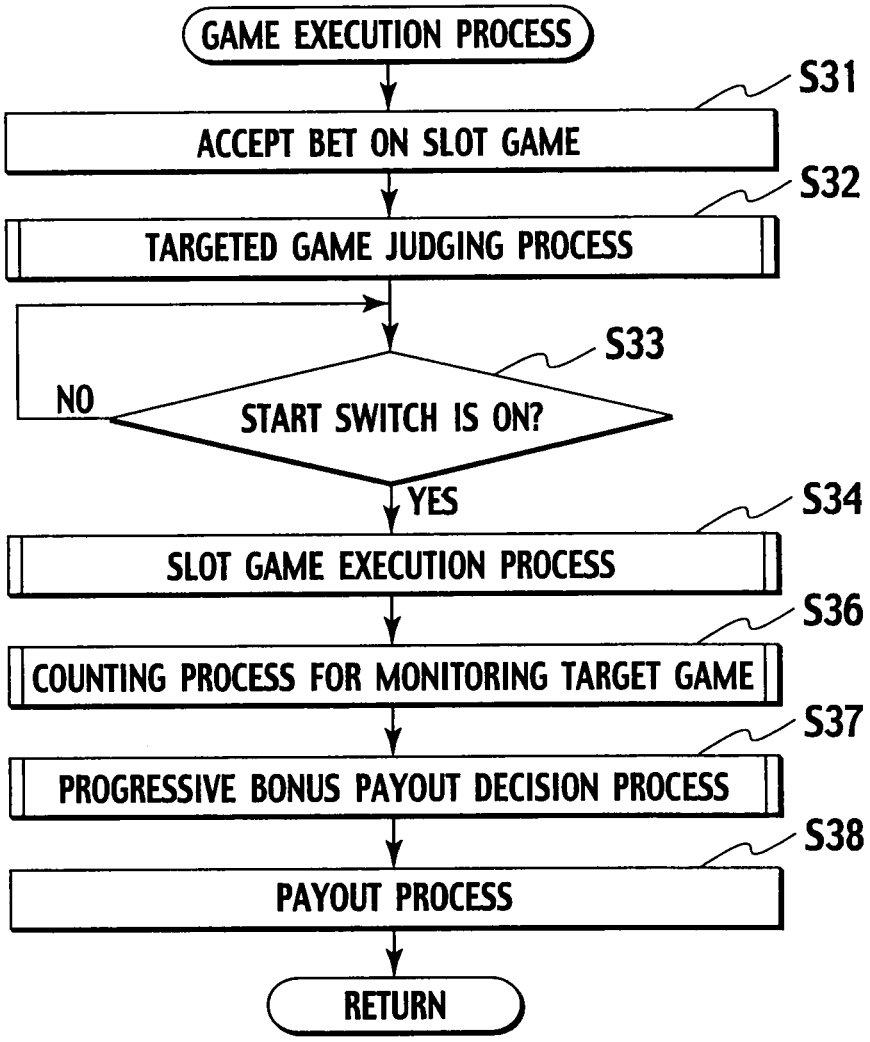
FIG. 9 is a flowchart showing procedures of a slot machine according to a first embodiment of the present invention.

In step S31 in FIG. 9, the CPU 106 shown in FIG. 8 firstly accepts a bet for a slot game which is about to be executed. To be more precise, when the medals are inserted from the medal insertion slot 21, the CPU 106 detects an operation in which: the player specifies the paylines to be bet by pressing the selection button 19 and the confirmation button 20; or the player bets the restricted credits on the specified paylines by pressing the MAXBET button 24 or the BET button 25.

Subsequently, in step S32, the CPU 106 executes a judging process to judge whether or not the slot game which is about to be executed is a monitoring target slot game that concerns payout provision of the progressive bonus. In this embodiment, this targeted game judging process is executed by judging whether or not the slot game which is about to be executed is a full-line bet slot game targeted for all the paylines. This game setting judging process is executed by making a reference to the content of the bet accepted in step S31. More details will be described later with reference to the flowchart shown in FIG. 10.

Thereafter, in step S33, the CPU 106 judges whether or not the start switch 27A is turned on along with the operation of the start button 27 by the player. The process goes to step S34 when the start switch 27A is judged to be turned on.

In step S34, the CPU 106 performs an execution process of the slot game. In this process, the CPU 106 performs a process to rearrange the symbols that are arranged in the 15 partitioned regions q11 to q53. More details will be described later with reference to the flowchart shown in FIG. 11.

In step S36, the CPU 106 executes a counting process for the monitoring target slot game. In this process, the CPU 106 executes a process to increment a count value in the counter 128 representing the number of the continuously-executed full-line bet slot games targeted for monitoring. More details will be described later with reference to the flowchart shown in FIG. 12.

In step S37, the CPU 106 executes progressive bonus payout decision process. In this process, the CPU 106 decides the payout content (including no payout) for the progressive bonus when a predetermined number of the monitoring target slot games are continuously executed. More details will be described later with reference to the flowchart shown in FIG. 13.

In step S38, the CPU 106 executes a payout process. In this process, the CPU 106 provides the payout in the form of the medals or the restricted credits when a winning combination is formed on any of bet paylines by symbols rearranged in the 15 partitioned regions q11 to q53 or when the payout content for the progressive bonus (excluding no payout) is decided. To be more precise, the CPU 106 provides the payout in the form of the medals or the restricted credits when the payout for the slot game becomes effective in a process of step S74 in FIG. 11 to be described later or the payout for the progressive bonus (excluding no payout) is decided in a process in step S103 in FIG. 13. Then, the process goes to the next game.

Figure 10:
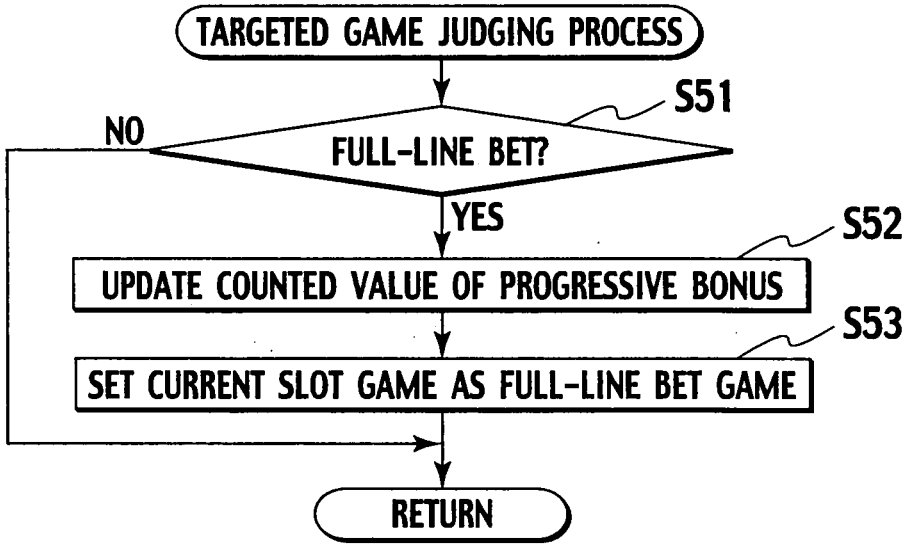
FIG. 10 is another flowchart showing the procedures of the slot machine according to the first embodiment of the present invention.

FIG. 10 is the flowchart showing detailed procedures of the targeted game judging process shown in step S32 in FIG. 9. First, in step S51, the CPU 106 judges whether or not the content of the bet accepted in step S31 corresponds to the full-line bet, i.e. the bet on all the paylines in one slot game session. The process goes to step S52 when the content of the accepted bet corresponds to the full-line bet (YES in step S51). On the other hand, the process is terminated when the content does not correspond to the full-line bet (NO in step S51).

In step S52, the CPU 106 executes a process for updating the counted value of the progressive bonus. In this process, the CPU 106 executes the process to increment the counted value for counting the resources for the progressive bonus to be counted by the counter 128 by an amount equivalent to some of the wager (such as credits equal to 1/10 of the total number of bets) every time of acceptance of the full-line bet of the wager in step S31.

Subsequently, in step S53 in FIG. 10, the CPU 106 sets the current slot game as the full-line bet slot game. Thereafter, the process is terminated.

Figure 11:
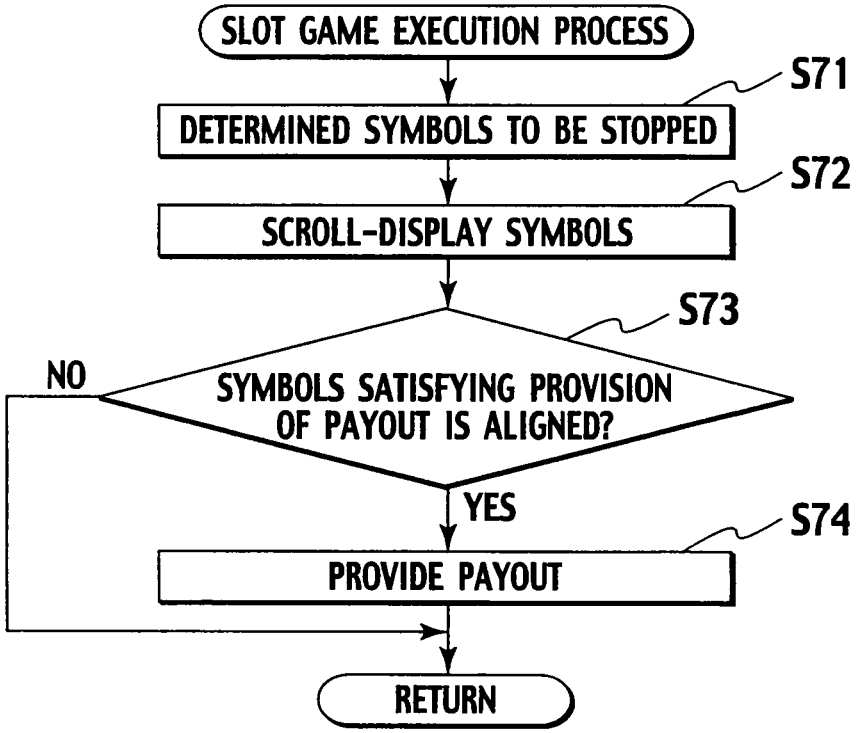
FIG. 11 is another flowchart showing the procedures of the slot machine according to the first embodiment of the present invention.

FIG. 11 is the flowchart showing procedures of the slot game execution process shown in step S34 in FIG. 9. Now, the slot game execution process will be described with reference to this drawing.

First, in step S71, the CPU 106 determines the symbols to be stopped in the respective partitioned regions q11 to q53 on the basis of the random number generated by the random number generating circuit 112 (see FIG. 8). Subsequently, in step S72, the symbols are scroll-displayed in the respective partitioned regions q11 to q53 and the symbols are stop-displayed after a lapse of a predetermined time period (for example, 5 seconds). The symbols to be stop-displayed at this time are the symbols determined in step S71. Thereafter, the process goes to step S73.

In step S73, the CPU 106 judges whether or not the wining combination representing the symbols for generating the payout is formed on any of the paylines by the symbols rearranged in the respective partitioned regions q11 to q53. The winning combinations are defined in a payout table shown in FIG. 14. To be more precise, a payout equivalent to 800 credits per credit is generated when five "DOUBLE" symbols are aligned in the respective partitioned regions q11 to q53, and a payout equivalent to 60 credits per credit is generated when five "triple BAR" symbols are aligned in the respective partitioned regions q11 to q53. Moreover, payouts are determined for each of the cases of alignment of five "double BAR" symbols, alignment of five "CHERRY" symbols, alignment of five "single BAR" symbols, alignment of five of any of the "triple BAR", "double BAR", and "single BAR" symbols (ANYBAR), alignment of two "CHERRY" symbols, and appearance of a single "CHERRY" symbol.

In step S74, the CPU 106 executes a process to generate the payout corresponding to any of the winning combinations described above. Thereafter, this process is terminated.

That is, in the slot game execution process shown in FIG. 11, when one of the winning combinations is aligned on any of the paylines activated by the full-line bet, the payout corresponding to the winning combination is generated.

Next, the counting process for the monitoring target slot game shown in step S36 in FIG. 9 will be described with reference to the flowchart shown in FIG. 12.

First, in step S91, the CPU 106 judges whether or not the slot game which is about to be executed is the full-line bet slot game. In this judging process, the process is terminated when the slot game is judged as not the full-line bet slot game (NO in step S91). On the other hand, the process goes to step S92 when the slot game is judged as the full-line bet slot game (YES in step S91).

In step S92, the CPU 106 judges whether or not the slot game which is about to be executed is the continuous full-line bet slot game. In this judging process, the process goes to step S93 when the slot game is judged as the continuous game (YES in step S92). On the other hand, the process goes to step S94 when the slot game is judged as not the continuous game (NO in step S92).

In step S93, the CPU 106 increments a counted value Ta representing the number of the continuously-executed full-line bet slot games. In other words, a calculation of Ta=Ta+1 is executed. Here, the counted value Ta is set equal to zero initially (when power is turned on). After completion of the incrementing process, the counting process is terminated. Meanwhile, in step S94, the CPU 106 sets the counted value Ta representing the number of the continuously-executed full-line bet slot games equal to "1". After completion of this setting process, the counting process is terminated.

In the counting process for the monitoring target game, assuming that the wager bet on the current slot game is the full-line bet, the counted value Ta is incremented when the slot game is the continuous full-line bet slot game whereas the counted value Ta is set equal to "1" when the slot game is not the continuous full-line bet game, thereby counting the number of the continuously-executed full-line bet slot games.

Next, procedures of the progressive bonus payout decision process shown in step S37 in FIG. 9 will be described with reference to the flowchart shown in FIG. 13. First, in step S101, the CPU 106 judges whether or not the current slot game is the full-line bet slot game. Specifically, the CPU 106 judges whether or not the slot game is set as the full-line bet slot game in the process shown in step S53 in FIG. 10. Then, the process goes to step S102 when the slot game is the full-line bet slot game. On the other hand, the process is terminated when the slot game is not the full-line bet slot game.

In step S102, the CPU 106 judges whether or not the counted value Ta for counting the number of the continuously-executed full-line bet slot games is equal to a preset upper limit value (a predetermined value) Ta max (such as Ta max=100). Then, the process goes to step S103 when Ta=Ta max holds true whereas the process is terminated when Ta=Ta max does not hold true.

In step S103, the CPU 106 decides the payout content for the progressive bonus. Here, the payout content for the progressive bonus is an amount of credits to be provided as the progressive bonus. There may also be a case of deciding the content as the amount of credits equal to zero, i.e. no payout for the progressive bonus. The counting process is terminated after completion of this decision process.

In this way, according to the slot machine 10 of this embodiment, the decision is made as to whether or not the progressive bonus is provided when the number of the continuously-executed full-line bet slot games reaches the preset upper limit value Ta max (the predetermined value). Moreover, when the progressive bonus is to be provided, the amount of the payout is decided and provided to the player.

Accordingly, although the player receives a smaller payout, when making a certain total amount of bet dispersedly on all the paylines, than another player can receive when making the same total amount of bet selectively on a single line or a few lines, the former player has a chance to receive the payout of the progressive bonus with a larger payout by continuously executing the full-line bet slot games the predetermined number of times.

Moreover, according to the slot machine 10 of this embodiment, some portions of the bets in the full-line bet slot game are accumulated as the resources for the progressive bonus. Accordingly, it is possible to raise a degree of expectation of the player over the payout for the progressive bonus while changing the resources and the payout for the progressive bonus by execution of the full-line bet slot games.

In this embodiment, the payout content for the progressive bonus is decided when the predetermined number of the full-line bet slot games are continuously executed. Instead, it is also possible to employ a configuration to decide the payout content for the progressive bonus when the counted value by the counter 128 for counting the resources for the progressive bonus is equal to or more than a predetermined value.

Now, a slot machine according to a second embodiment of the present invention having this configuration will be described. In the slot machine 10 according to the second embodiment of the present invention, the counting process for the monitoring target slot game shown in step S36 in FIG. 9 is omitted as shown in a flowchart in FIG. 15.

Figure 13:
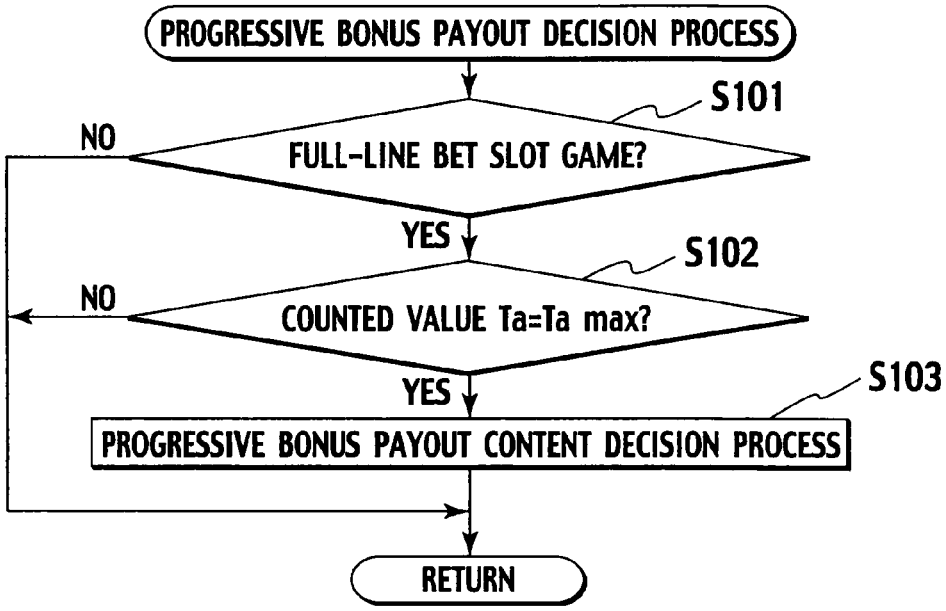
FIG. 13 is another flowchart showing the procedures of the slot machine according to the first embodiment of the present invention.

Meanwhile, in the slot machine 10 of the second embodiment, the contents of the progressive bonus payout decision process shown in step S37 in FIG. 9 will be partially altered from the contents of the process of the first embodiment shown in FIG. 13.

Figure 16:
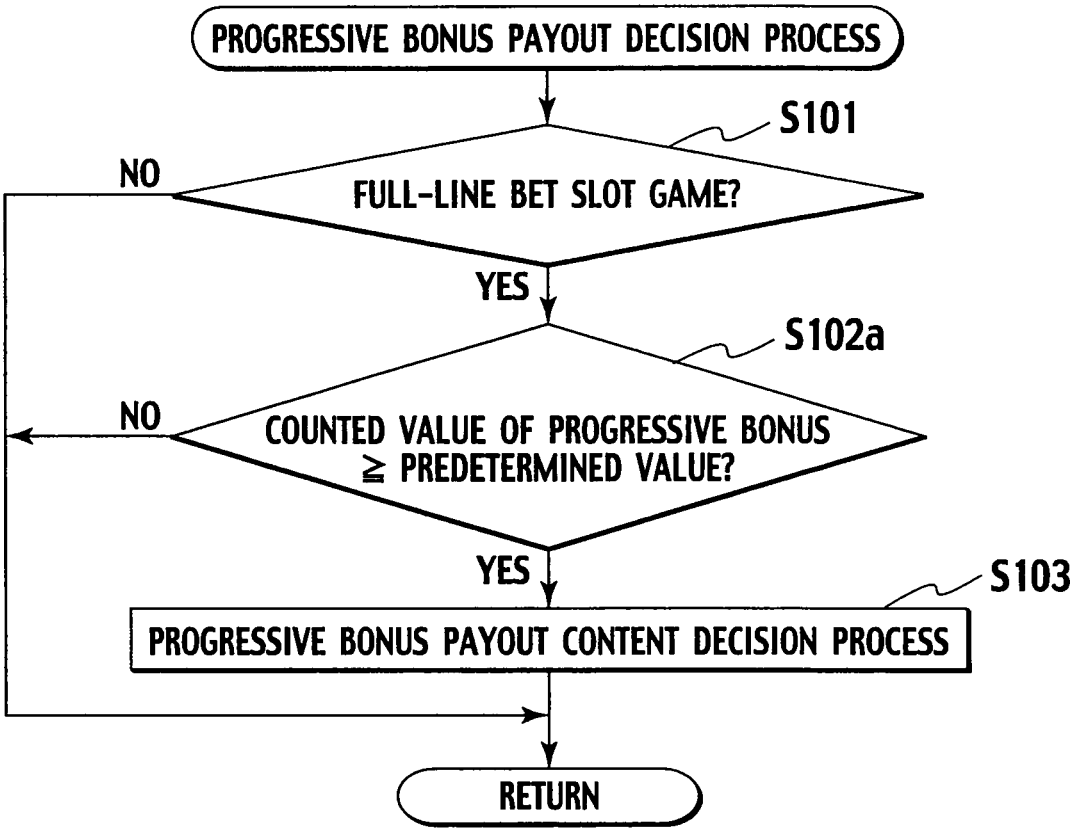
FIG. 16 is another flowchart showing the procedures of the slot machine according to the second embodiment of the present invention.

Moreover, in the slot machine 10 of the second embodiment, a process shown in the flowchart in FIG. 16 will be executed in the progressive bonus payout decision process shown in step S37 in FIG. 9.

That is, when the current slot game is the full-line bet slot game (YES in step S101), using the counter 128, the CPU 106 judges whether or not a counted value of the resources for the progressive bonus updated in step S52 in FIG. 10 is equal to or more than a predetermined value in step S102*a*. Then, the process goes to step S103 when the counted value is equal to or more than the predetermined value. On the other hand, this process is terminated when the counted value is not equal to or more than the predetermined value.

In this way, according to the slot machine 10 of this embodiment, the decision is made as to whether or not the progressive bonus is provided when the counted value of the resources for the progressive bonus, which represents accumulation of some portions of the bets on the full-line bet slot games, becomes equal to or more than the predetermined value. Moreover, when the progressive bonus is provided, the amount of the payout is decided and provided to the player.

Accordingly, although the player receives a smaller payout, when making a certain total amount of bet dispersedly on all the paylines, than another player can receive when making the same total amount of bet selectively on a single line or a few lines, the former player has a chance to receive the progressive bonus with a larger payout as a result of accumulating the resources for the progressive bonus equal to or more than the predetermined value.

Moreover, according to the slot machine 10 of this embodiment, some portions of the bets in the full-line bet slot game are accumulated as the resources for the progressive bonus. Accordingly, accumulation of the resources for the progressive bonus equal to or more than the predetermined value by repeating execution of the full-line bet slot games will result in a chance to receive the progressive bonus with a larger payout. In this way, it is possible to raise a degree of expectation of the player over the payout for the progressive bonus who repeats the full-line bet slot games.

Here, in the case of the slot machine 10 of the second embodiment, the counted value concerning the resources for the progressive bonus counted by the counter 128 may be displayed on the display 16, for example. In particular, it is also possible to change a display color or a display mode of the counted value by the counter 128 depending on whether or not the counted value is equal to or more than the predetermined value.

Moreover, in the above-described first and second embodiments, the subject of accumulating some portions of the bets on the slot games as the resources for the progressive bonus and the decision of the payout content for the progressive bonus is limited to the full-line bet slot game.

However, instead of limiting the subject to the full-line bet game, it is also possible to cover a slot game in which a bet is made on a predetermined number or more of the paylines as the subject of accumulating some portions of the bets on the slot games as the resources for the progressive bonus and the decision of the payout content for the progressive bonus.

Accordingly, slot machines according to third and fourth embodiments of the present invention having the above-described configurations will now be described. In the slot machine 10 according to the third embodiment of the present invention, the contents of the process to judge whether or not the slot game is the monitoring target slot game as shown in step S32 in FIG. 9 are partially altered from the contents of the process in the first embodiment shown in FIG. 10.

Figure 12:
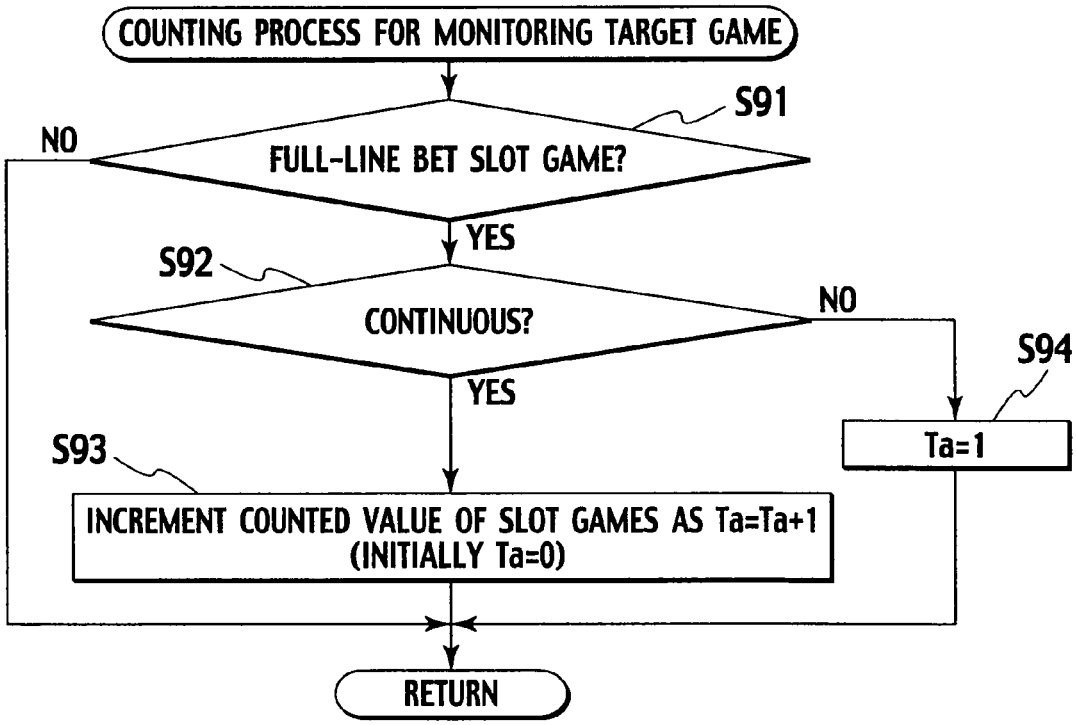
FIG. 12 is another flowchart showing the procedures of the slot machine according to the first embodiment of the present invention.

Moreover, in the slot machine 10 according to the third embodiment, the contents of the counting process for the monitoring target slot game shown in step S36 in FIG. 9 are altered from the contents of the process in the first embodiment shown in FIG. 12.

Further, in the slot machine 10 according to the third embodiment, the contents of the progressive bonus payout decision process shown in step S37 in FIG. 9 are partially altered from the contents of the process in the first embodiment shown in FIG. 13.

Figure 17:
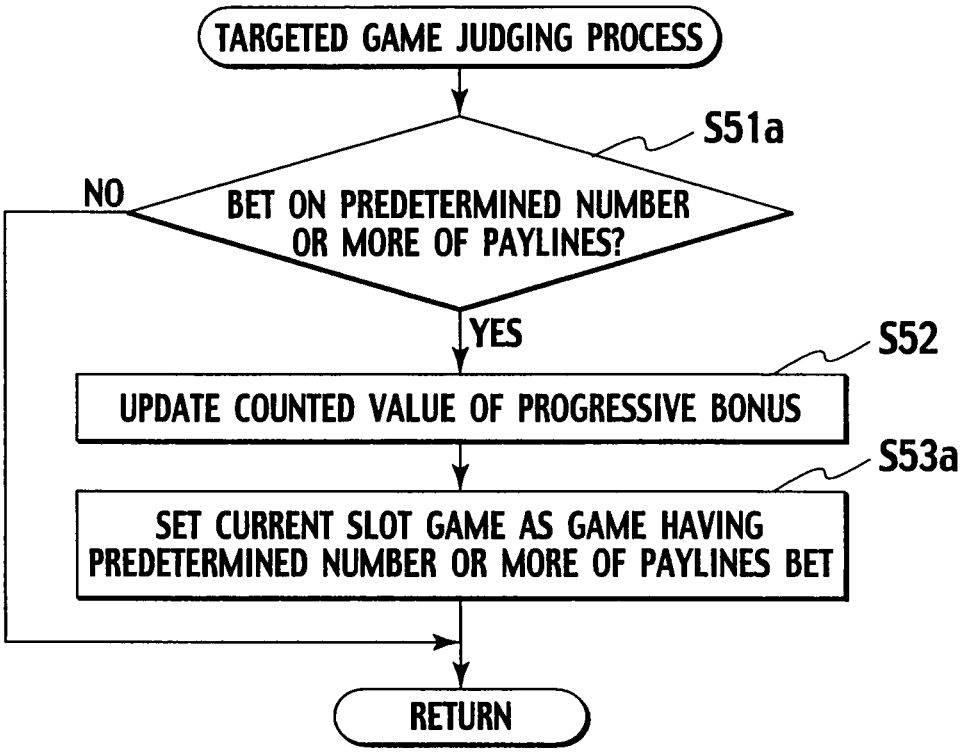
FIG. 17 is a flowchart showing procedures of a slot machine according to a third embodiment of the present invention.

Now, in the slot machine 10 according to the third embodiment, in the process to judge whether or not the slot game is the monitoring target slot game as shown in step S32 in FIG. 9, the CPU 106 firstly judges whether or not the contents of the bet accepted in step S31 is targeted for the predetermined number or more of the paylines in step S51*a* as shown in a flowchart in FIG. 17. Then, the process goes to step S52 when the accepted bet content is targeted for the predetermined number or more of the paylines (YES in step S51*a*). On the other hand, this process is terminated when the bet content is not targeted for the predetermined number or more of the paylines (NO in step S51*a*).

In step S52, the CPU 106 executes the updating process for the counted value of the progressive bonus as similar to the case of the slot machine 10 of the first embodiment. Subsequently, in step S53*a* in FIG. 10, the CPU 106 sets the current slot game as the slot game in which the predetermined number or more of the paylines are bet. Thereafter, the process is terminated.

Figure 18:
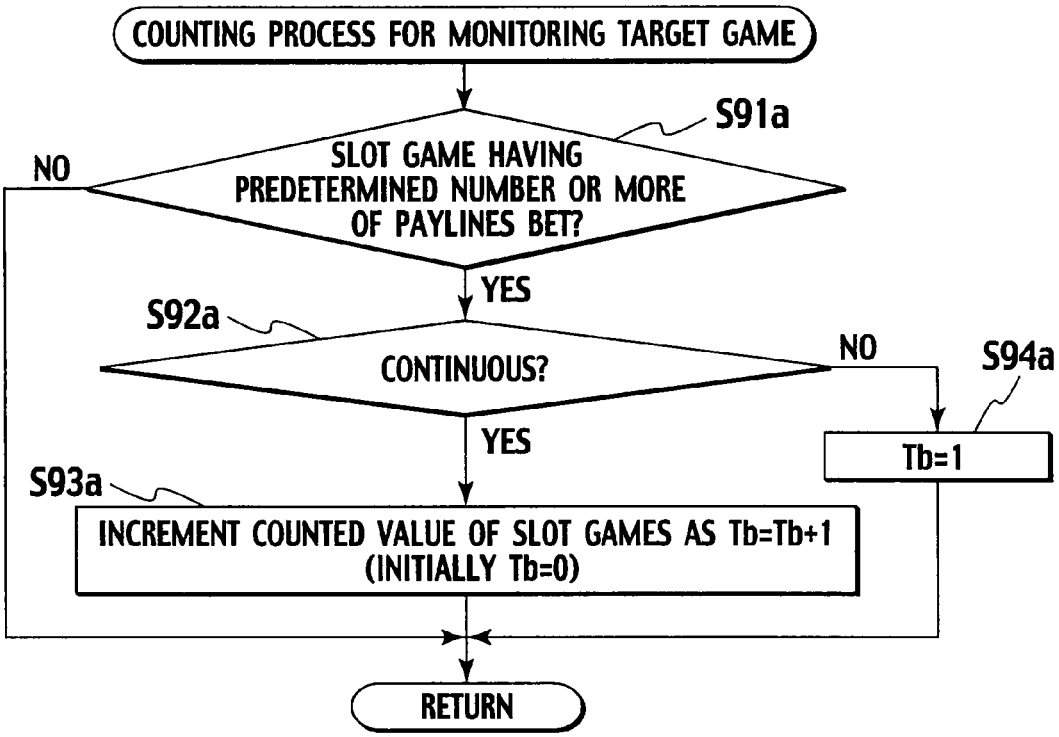
FIG. 18 is another flowchart showing the procedures of the slot machine according to the third embodiment of the present invention.

Meanwhile, in the slot machine 10 of the third embodiment, in the counting process for the monitoring target slot game shown in step S36 in FIG. 9, the CPU 106 firstly judges whether or not the slot game which is about to be executed is the slot game in which the predetermined number or more of the paylines are bet. in step S91*a* as shown in a flowchart in FIG. 18. In this judging process, the process is terminated when the slot game is judged as not the slot game in which the predetermined number or more of the paylines are bet (NO in step S91*a*). On the other hand, the process goes to step S92*a* when the slot game is judged as the slot game in which the predetermined number or more of the paylines are bet (YES in step S91*a*).

In step S92*a*, the CPU 106 judges whether or not the slot game which is about to be executed is the continuous slot game in which the predetermined number or more of the paylines are bet. In this judging process, the process goes to step S93*a* when the slot game is judged as the continuous game (YES in step S92*a*). On the other hand, the process goes to step S94*a* when the slot game is judged as not the continuous game (NO in step S92*a*).

In step S93*a*, the CPU 106 increments a counted value Tb representing a number of the continuously-executed slot games in which the predetermined number or more of the paylines are bet. In other words, a calculation of Tb=Tb+1 is executed. Here, the counted value Tb is set equal to zero initially (when power is turned on). After completion of the incrementing process, the counting process is terminated. Meanwhile, in step S94*a*, the CPU 106 sets the counted value Tb representing the number of the continuously-executed slot games in which the predetermined number or more of the paylines are bet equal to "1". After completion of this setting process, the counting process is terminated.

Figure 19:
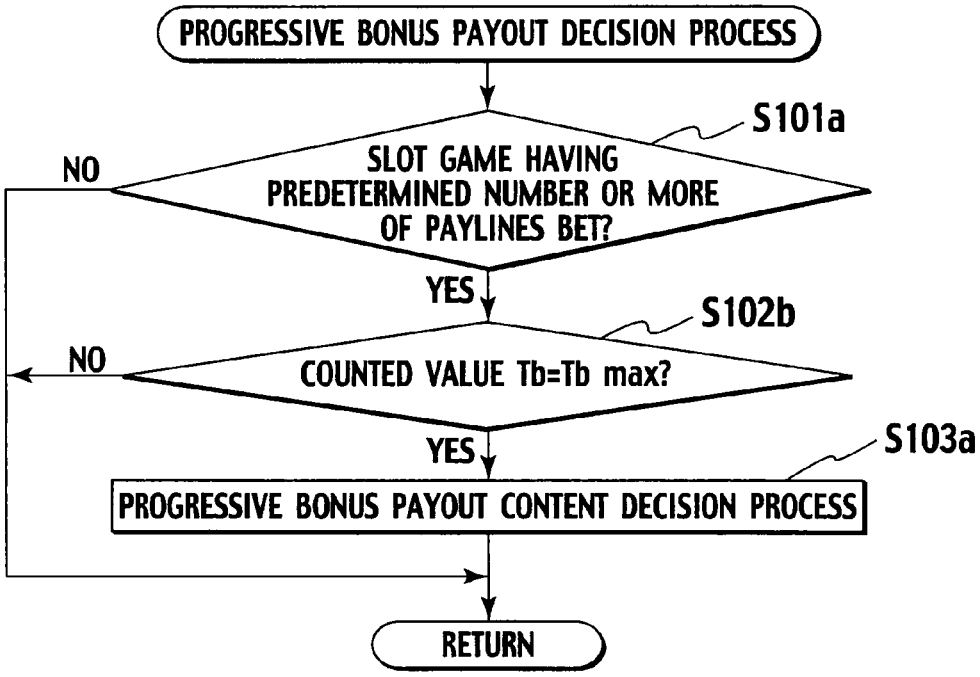
FIG. 19 is another flowchart showing the procedures of the slot machine according to the third embodiment of the present invention.

Moreover, in the slot machine 10 according to the third embodiment, in the progressive bonus payout decision process shown in step S37 in FIG. 9, the CPU 106 judges whether or not the current slot game is the slot game in which the predetermined number or more of the paylines are bet in step S101*a* as shown in a flowchart in FIG. 19. Specifically, the CPU 106 judges whether or not the slot game is set as the slot game in which the predetermined number or more of the paylines are bet in the process shown in step S53*a* in FIG. 17. Then, the process goes to step S102*b* when the slot game is the slot game in which the predetermined number or more of the paylines are bet. On the other hand, the process is terminated when the slot game is not the slot game in which the predetermined number or more of the paylines are bet.

In step S102*b*, the CPU 106 judges whether or not the counted value Tb for counting the number of the continuously-executed slot games in which the predetermined number or more of the paylines are bet is equal to a preset upper limit value (a predetermined value) Tb max (such as Tb max=100). Then, the process goes to step S103*a* when Tb=Tb max holds true whereas the process is terminated when Tb=Tb max does not hold true. the number of the continuously-executed full-line bet slot games In step S103*a*, the CPU 106 decides the payout content for the progressive bonus as similar to the case of the slot machine 10 of the first embodiment. The counting process is terminated after completion of this decision process.

In this way, according to the slot machine 10 of this embodiment, the decision is made as to whether or not the progressive bonus is provided when the number of the continuously-executed slot games in which the predetermined number or more of the paylines are bet reaches the preset upper limit value Tb max (the predetermined value). Moreover, the progressive bonus is provided, the amount of the payout is decided and provided to the player.

Accordingly, although the player receives a smaller payout, when making a certain total amount of bet dispersedly on the predetermined number or more of the paylines, than another player can receive when making the same total amount of bet selectively on a single line or a few lines, the former player has a chance to receive the progressive bonus with a larger payout by continuously executing the predetermined number of the slot games in which the predetermined number or more of the paylines are bet.

Moreover, according to the slot machine 10 of this embodiment, some portions of the bets in the slot games in which the predetermined number or more of the paylines are bet are accumulated as the resources for the progressive bonus. Accordingly, it is possible to raise a degree of expectation of the player over the payout for the progressive bonus while changing the resources and the payout for the progressive bonus by execution of the slot games in which the predetermined number or more of the paylines are bet.

Figure 15:
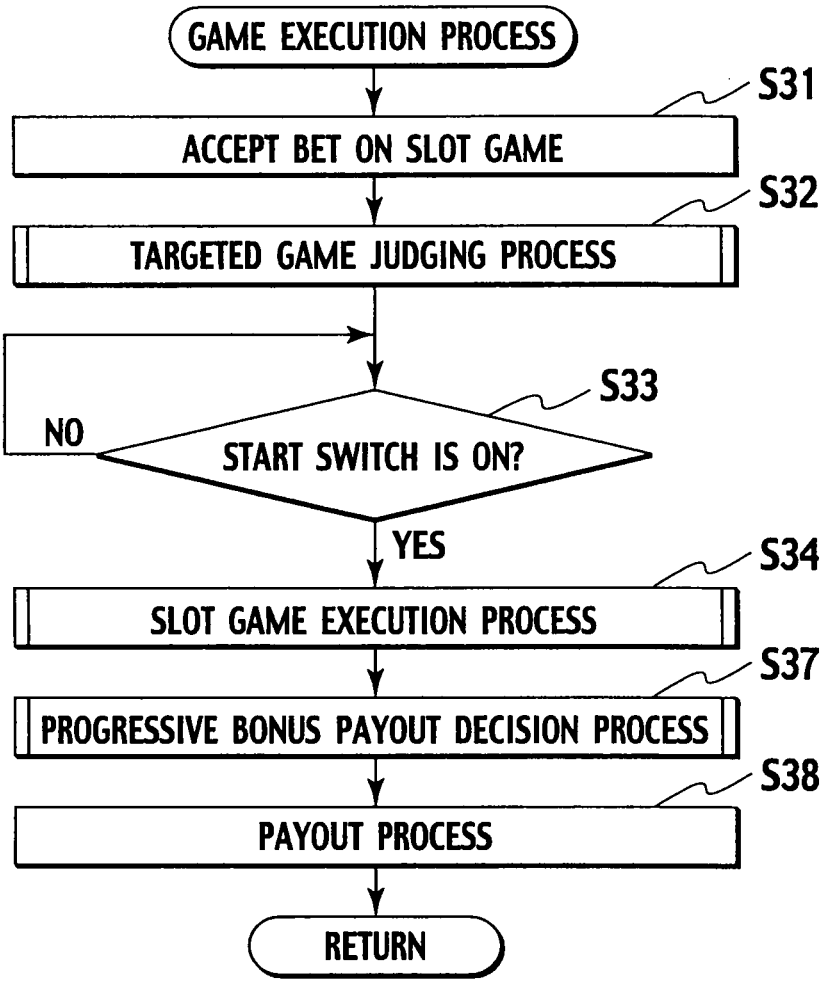
FIG. 15 is a flowchart showing procedures of a slot machine according to a second embodiment of the present invention.

Next, in the slot machine 10 according to the fourth embodiment of the present invention, the counting process for the monitoring target slot game shown in step S36 in a flowchart in FIG. 15, which is executed by the slot machine 10 of the third embodiment, is omitted.

Meanwhile, in the slot machine 10 of the fourth embodiment, the contents of the progressive bonus payout decision process shown in step S37 in FIG. 9 will be partially altered from the contents of the process of the third embodiment shown in FIG. 19.

Figure 20:
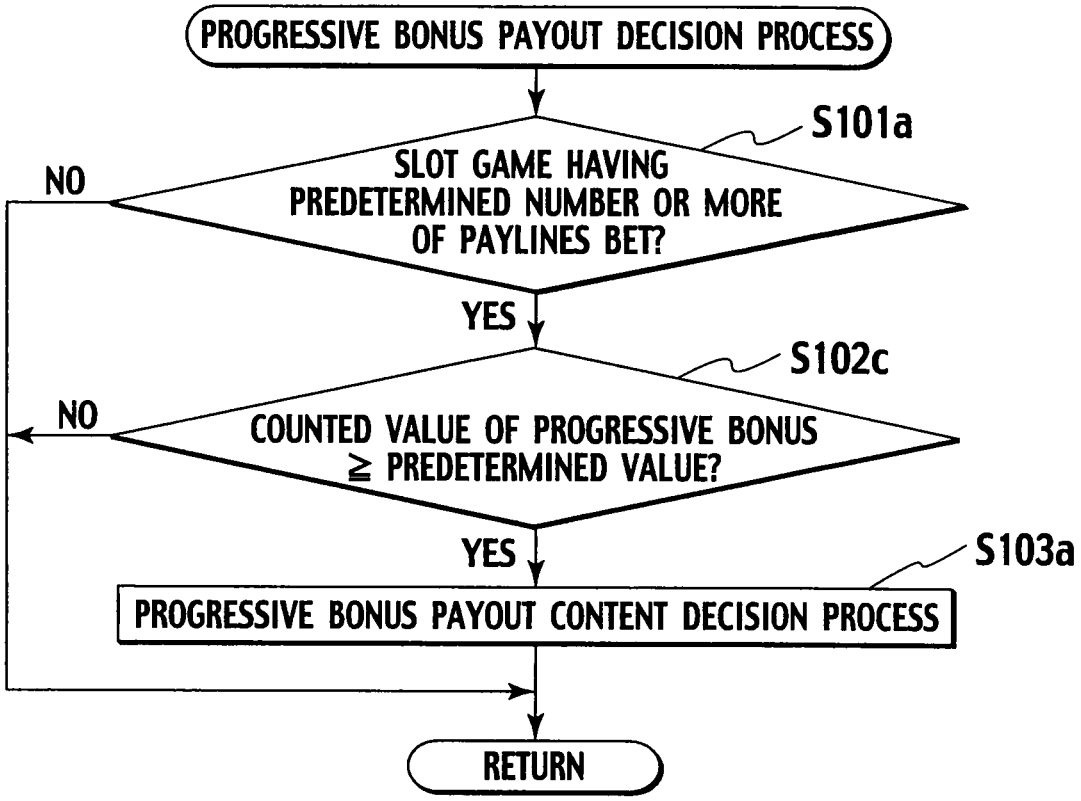
FIG. 20 is a flowchart showing procedures of a slot machine according to a fourth embodiment of the present invention.

Moreover, in the slot machine 10 of the fourth embodiment, a process shown in a flowchart in FIG. 20 will be executed in the progressive bonus payout decision process shown in step S37 in FIG. 9.

That is, when the current slot game is the slot game in which the predetermined number or more of the paylines are bet (YES in step S101*a*), using the counter 128, the CPU 106 judges whether or not the counted value of the resources for the progressive bonus updated in step S52 in FIG. 10 is equal to or more than a predetermined value in step S102*c*. Then, the process goes to step S103*a* when the counted value is equal to or more than the predetermined value. On the other hand, this process is terminated when the counted value is not equal to or more than the predetermined value.

In this way, according to the slot machine 10 of this embodiment, the decision is made as to whether or not the progressive bonus is provided when the counted value of the resources for the progressive bonus, which represents accumulation of some portions of the bets on the slot games in which the predetermined number or more of the paylines are bet, becomes equal to or more than the predetermined value. Moreover, the progressive bonus is provided, the amount of the payout is decided and provided to the player.

Therefore, even if the amount of the payout becomes less as a result of dispersing the bet on the predetermined number or more of the paylines in comparison with a payout that the player can receive as a consequence of formation of a winning combination on an activated payline when the player makes a bet in the same amount selectively on a single line or a few lines, the player has a chance to receive the progressive bonus with a larger payout as a result of accumulating the resources for the progressive bonus equal to or more than the predetermined value.

Moreover, according to the slot machine 10 of this embodiment, some portions of the bets in the slot game in which the predetermined number or more of the paylines are bet are accumulated as the resources for the progressive bonus. Accordingly, accumulation of the resources for the progressive bonus equal to or more than the predetermined value by repeating execution of the slot games in which the predetermined number or more of the paylines are bet will result in a chance to receive the progressive bonus having a larger payout. In this way, it is possible to raise a degree of expectation of the player over the payout for the progressive bonus who repeats the slot games in which the predetermined number or more of the paylines are bet.

As similar to the slot machine 10 of the second embodiment, in the case of the slot machine 10 of the fourth embodiment, the counted value concerning the resources for the progressive bonus counted by the counter 128 may also be displayed on the display 16, for example. In particular, it is also possible to change a display color or a display mode of the counted value by the counter 128 depending on whether or not the counted value is equal to or more than the predetermined value.

Moreover, in the above-described first to fourth embodiments, the rearrangement of the symbols in the respective partitioned regions q11 to q53 on the display 16 are performed in the form of a display on a liquid crystal panel included in the display 16.

However, it is also possible to form the display 16 by using a transparent member and to rearrange the symbols in the respective partitioned regions q11 to q53 by use of a rotatable reel device disposed behind the display 16.

Figure 21:
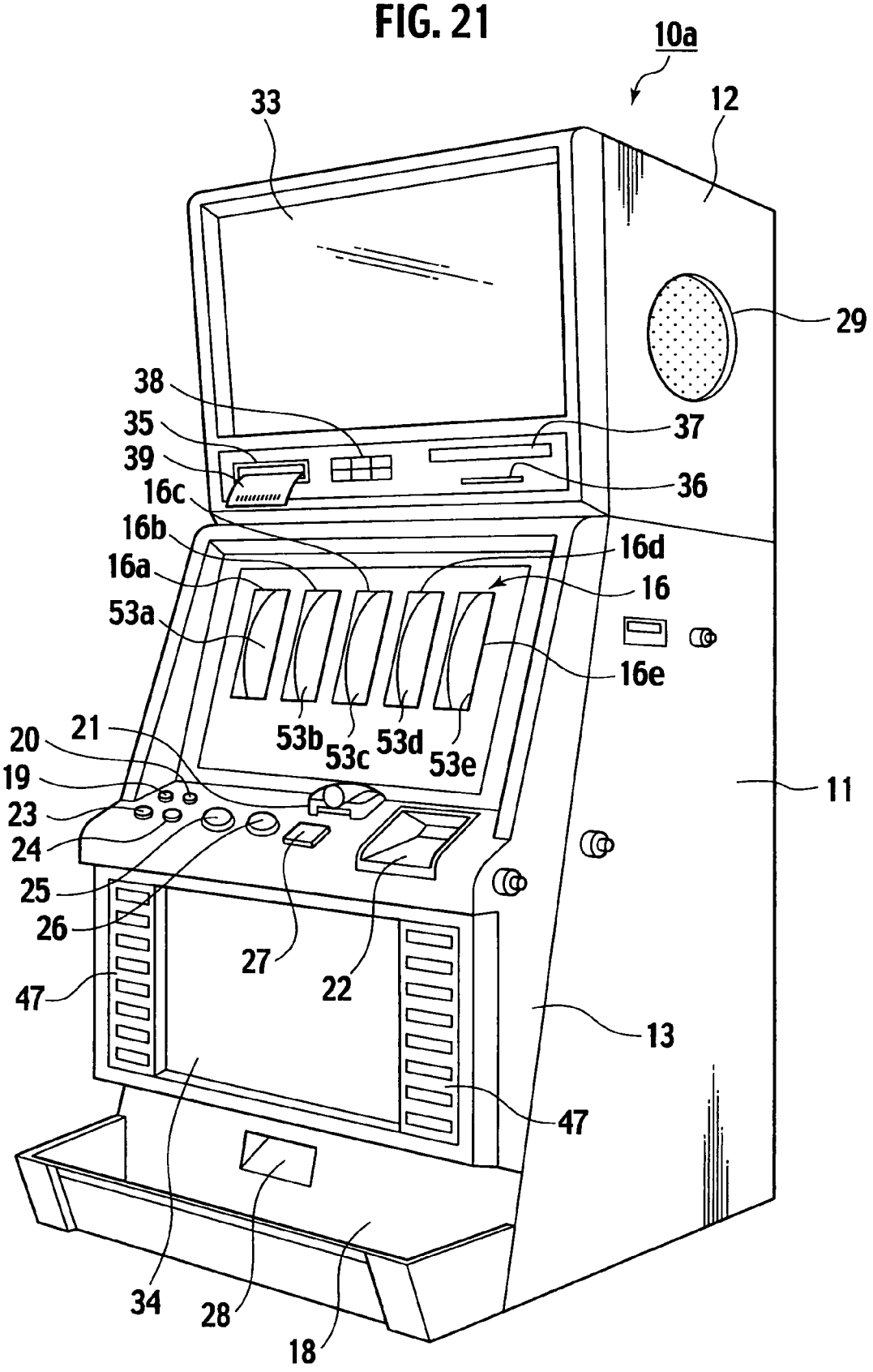
FIG. 21 is a perspective view of a slot machine according to a fifth embodiment of the present invention.
Figure 22:
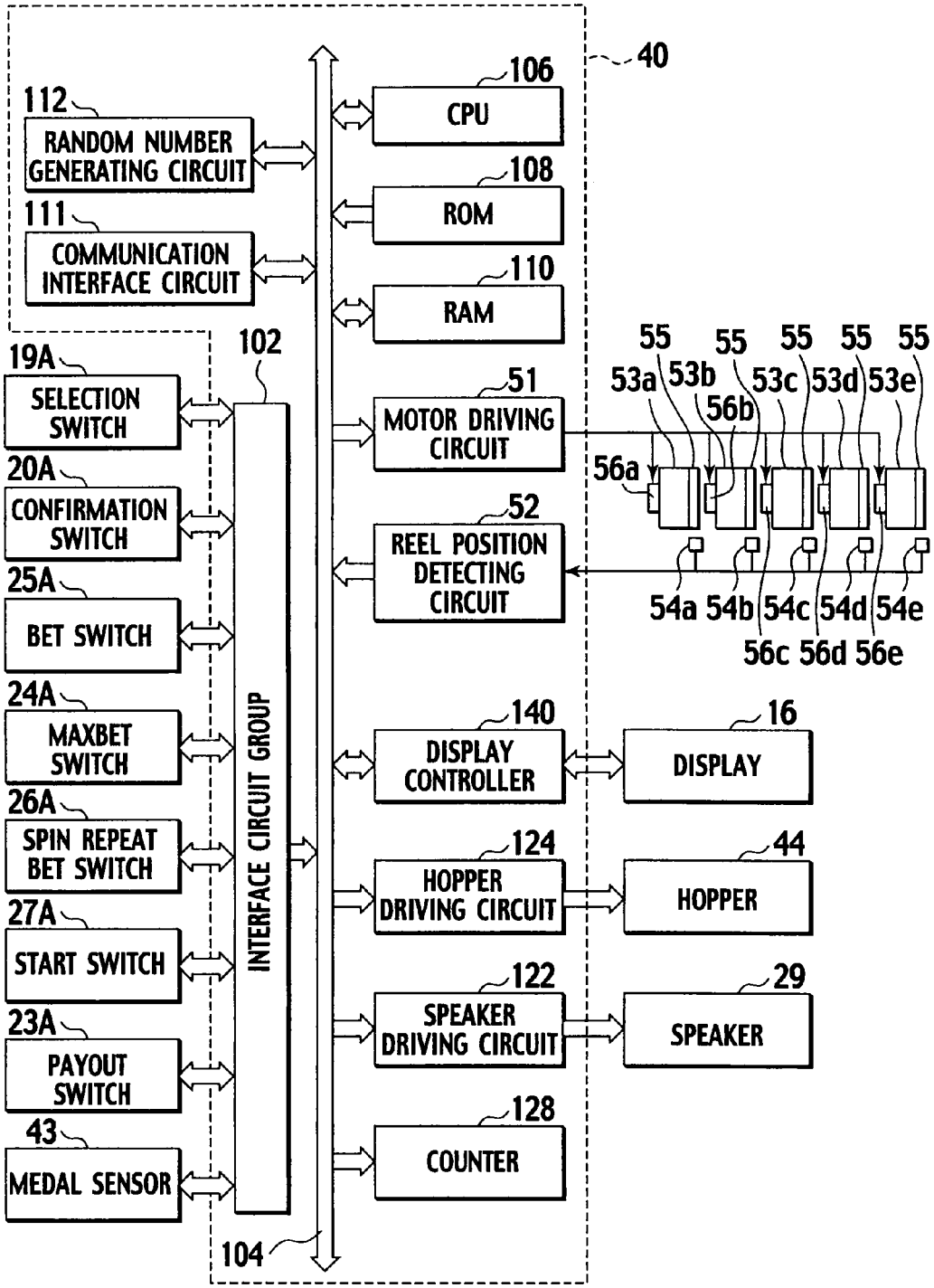
FIG. 22 is a block diagram showing a control circuit of the slot machine according to the fifth embodiment of the present invention.
Figure 23A:
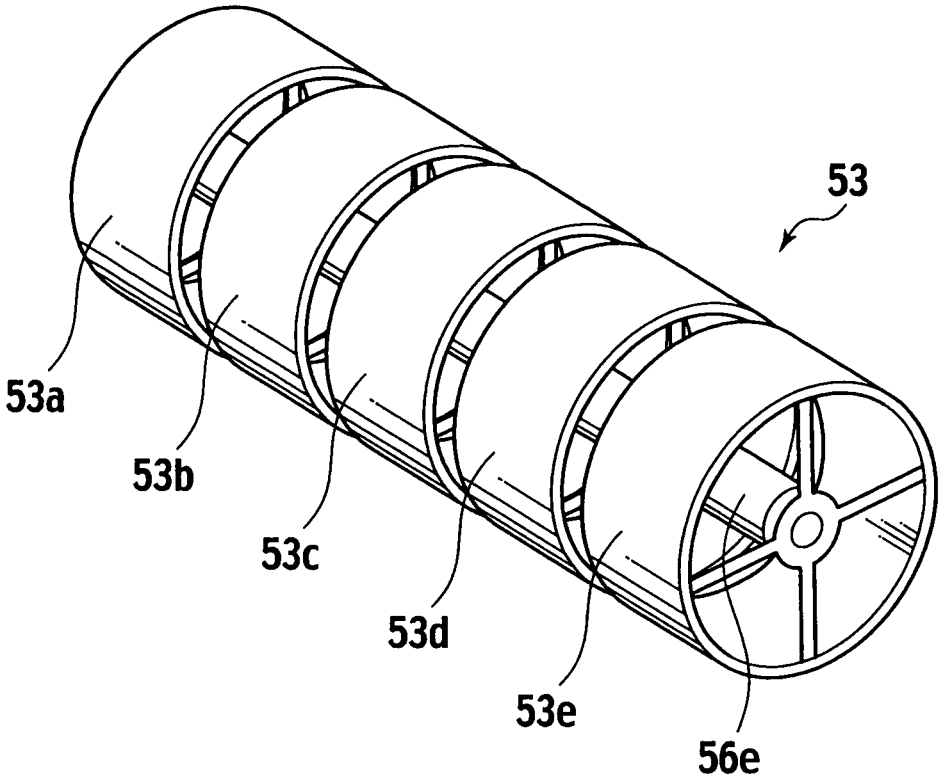
FIG. 23A is a perspective view showing a rotatable reel device of the slot machine according to the fifth embodiment of the present invention.
Figure 23B:
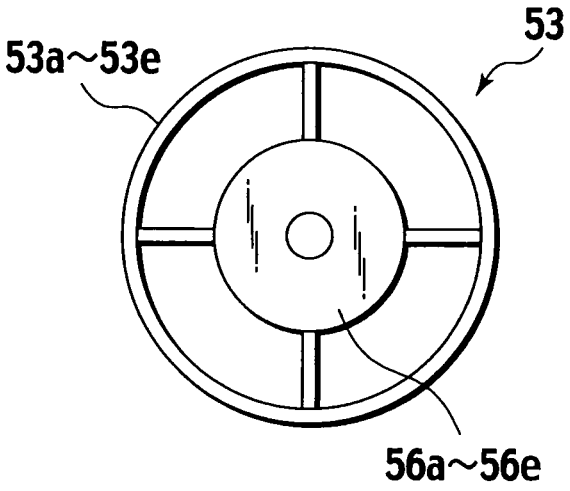
FIG. 23B is a side view showing the rotatable reel device of the slot machine according to the fifth embodiment of the present invention.

Now, a slot machine according to a fifth embodiment of the present invention configured to rearrange the symbols by use of a rotatable reel device will be described below. FIG. 21 is a perspective view of the slot machine according to the fifth embodiment of the present invention. FIG. 22 is a block diagram showing a control circuit of the slot machine according to the fifth embodiment of the present invention. FIG. 23A is a perspective view showing a rotatable reel device of the slot machine according to the fifth embodiment of the present invention. FIG. 23B is a side view showing the rotatable reel device of the slot machine according to the fifth embodiment of the present invention.

As shown in FIG. 21, a slot machine 10*a* of this embodiment provides the display 16 with windows 16*a* to 16*e*, which are transparently displayed at any time so as to correspond respectively to first to fifth columns. Moreover, inside the cabinet 11, a rotatable reel device 53 is disposed behind the display 16.

As shown in FIG. 23A, the rotatable reel device 53 includes five rotatable reels 53*a* to 53*e* that correspond to the respective windows 16*a* to 16*e* of the display 16. Moreover, as shown in FIG. 23B, the rotatable reel device 53 includes driving motors 56*a* to 56*e* formed of stepping motors for rotating the respective rotatable reels 53*a* to 53*e*. The rotatable reel device 53 further includes sensors 54*a* to 54*e* (see FIG. 22) for reading bar codes or counting the number of passage of slits in order to detect rotation, stops, and stopped rotational positions of the respective rotatable reels 53*a* to 53*e*. Meanwhile, multiple symbols including the symbols defined on the table in FIG. 14 are laid out on a circumferential surface of each of the rotatable reels 53*a* to 53*e* at even intervals.

Moreover, the slot machine 10*a* of this embodiment allow the player to view three continuous symbols out of the symbols laid out on the circumferential surface of each of the rotatable reels 53*a* to 53*e* through each of the windows 16*a* to 16*e* of the display 16. That is, the windows 16*a* to 16*e* define the partitioned regions q11 to q13, q21 to q23, q31 to q33, q41 to q43, and q51 to q53 in the direction of three upper, middle, and lower rows corresponding to first to fifth columns, respectively.

Moreover, in the slot machine 10*a* of this embodiment, as shown in FIG. 22, the controller 40 includes a motor driving circuit 51 configured to drive the respective driving motors 56*a* to 56*e* in the rotatable reel device 53, and a reel position detection circuit 52 configured to detect rotation, stops, and stopped positions of the respective rotatable reels 53*a* to 53*e* by use of outputs from the respective sensors 54*a* to 54*e* in the rotatable reel device 53.

The respective sensors 54*a* to 54*e* are disposed so as to face margins 55 secured beside layout regions for the respective symbols on the circumferential surface of the corresponding rotatable reels 53*a* to 53*e*. Moreover, the respective sensors 54*a* to 54*e* can detect rotation, stops, and stopped positions of the respective rotatable reels 53*a* to 53*e* by detecting identifiers such as bar codes that are laid out on the margins 55 so as to correspond to the respective symbols. Here, it is possible to employ various known methods including optical methods or magnetic methods for detection of the identifiers by the respective sensors 54*a* to 54*e*.

In the slot machine 10*a* of this embodiment having the above-described configuration, the process for scroll-displaying of the symbols in all the partitioned regions q11 to q53 and stop-displaying of the symbols after a lapse of a predetermined time period (such as 5 seconds) as described in step S72 in the slot game execution process in FIG. 11 is achieved by driving the respective driving motors 56*a* to 56*e* by using the motor driving circuit 51 and rotating and stopping the respective rotatable reels 53*a* to 53*e* of the rotatable reel device 53.

Meanwhile, in the slot machine 10*a* of this embodiment, the process for judging whether or not the wining combination is formed on any of the paylines as described in step S73 in the slot game execution process in FIG. 11 is achieved by way of detection results of rotation, stops, and stopped positions of the respective rotatable reels 53*a* to 53*e*, which are detected by the reel position detection circuit 52 using the outputs from the respective sensors 54*a* to 54*e*.

According to the slot machine 10*a* of the fifth embodiment having the above-described configuration, it is also possible to obtain effects similar to the slot machines 10 of the first to fifth embodiments.

The gaming machine and the playing method of the gaming machine of the present invention have been described based on the illustrated embodiments. However, it is to be noted that the present invention will not be limited only to these embodiments and the configurations of the respective constituents can be replaced by any configurations having similar functions.

For example, the foregoing embodiments have described the examples in which the display 16 is provided with fifteen partitioned regions q11 to q53 and the slot game is executed by using these partitioned regions q11 to q53. However, the present invention is not limited only to this configuration. The present invention can also employ various other display regions including a display region in a matrix of three rows and three columns, for example.

In addition, in the detailed description above, the characteristic portions are mainly described in order to make the present invention easily understandable. The present invention is not limited to the embodiments described in the detailed description above, and can be applied to the other embodiments, and its range of application is wide. Also, the terms and the terminology used in the present specification are used only for the purpose of explaining the present invention precisely, and not used for the purpose of limiting the interpretation of the present invention. Also, for those skilled in the art, it should be easy to contemplate other configurations, systems, methods, etc., that are contained in the concept of the present invention, from the content of the invention described in the present specification. Consequently, the description of the scope of claims should be construed as containing equivalent configurations within a range of not deviating from a range of the technical ideas of the present invention. Also, the purpose of the abstract is to make it possible for the patent office, the general public organizations, and technicians and the like who belong to the present technical field and who are not thoroughly familiar with patent and law terms or specialized terms, to quickly judge the technical content and its essence of the present application by a simple search. Consequently, the abstract is not intended to limit the scope of the invention which should be evaluated by the description of the scope of claims. Also, in order to sufficiently understand the purpose of the present invention and the effects specific to the present invention, they should preferably be interpreted by sufficiently referring to the documents and the like that are already disclosed in public.

Also, the detailed description above contains the processing to be executed by a computer. The explanations and expressions in the above are described for the purpose of facilitating the most efficient understanding by those skilled in the art. In the present specification, each step used in deriving one result should be understood as a processing without a self-contradiction. Also, at each step, transmission and reception, recording, etc., of electric or magnetic signals will be carried out. In the processing at each step, such signals are expressed by bits, values, symbols, letters, terms, numbers, etc., but it should be noted that they are used simply because they are convenient for the purpose of explanation. Also, there are cases where the processing at each step is described by an expression common to the human behavior, but the processing described in the present specification is to be executed by various devices in principle. Also, the other configuration required in carrying out each step will be obvious from the above description.

What is claimed is:

1. A slot machine comprising:

a display configured to display a unit game causing a plurality of arranged symbols to be rearranged;

a button configured to specify at least one payline for bet for each unit game, out of a plurality of paylines set on the display, wherein each unit game is executable in a repetitive manner and each unit game requires an operation of specifying at least one payline by the button to start after a previous unit game is finished;

a counter configured to accumulate a counted value of a progressive bonus;

a value-addition mechanism by which a player is able to add to the slot machine game media to be bet;

an award payout mechanism by which game media can be paid out to the player or credited to memorized credits of the player; and a controller configured to, as a result of the player having bet game media:

(a) repeatedly execute a plurality of unit games in the game machine;

(b) increment, in a unit game in which all the paylines are specified for bet, the counted value by some of an amount of bet made on the unit game in which all the paylines are specified for bet, to accumulate the counted value, and display an accumulated counted value on the display, wherein the counted value is maintained regardless of the accumulated counted value in a unit game in which a number of paylines that are specified for bet is less than a number of all the paylines;

(b1) change a display mode of the accumulated counted value displayed on the display when the accumulated counted value is equal to or more than a predetermined value;

(c) decide whether or not to provide an award for the progressive bonus only in a certain unit game of unit games in which all the paylines are specified for bet by an operation of the button by a player; and (d) upon decision of providing the award for the progressive bonus, provide at least some of the accumulated counted value to the player as the award for the progressive bonus in the certain unit game in which all the paylines are specified for bet, wherein, upon the unit games in which all the paylines are specified for bet being continuously executed a predetermined number of times being greater than one, the controller is configured to decide whether or not to provide the award for the progressive bonus in a last unit game of the continuously executed unit games.

2. The slot machine according to claim 1, wherein, upon the accumulated counted value being equal to or more than the predetermined value, the controller is configured to decide whether or not to provide the award for the progressive bonus in the unit game in which all the paylines are specified for bet.

3. A slot machine comprising:

a display configured to display a unit game causing a plurality of arranged symbols to be rearranged;

a button configured to specify at least one payline for bet for each unit game, out of a plurality of paylines set on the display, wherein each unit game is executable in a repetitive manner and each unit game requires an operation of specifying at least one payline by the button to start after a previous unit game is finished;

a counter configured to accumulate a counted value of a progressive bonus;

a value-addition mechanism by which a player is able to add to the slot machine game media to be bet;

an award payout mechanism by which game media can be paid out to the player or credited to memorized credits of the player; and a controller configured to, as a result of the player having bet game media:

(a) repeatedly execute a plurality of unit games in the game machine;

(b) increment, in a unit game in which all the paylines are specified for bet, the counted value by some of an amount of bet made on the unit game in which all the paylines are specified for bet, to accumulate the counted value, and display an accumulated counted value on the display, wherein the counted value is maintained regardless of the accumulated counted value in a unit game in which a number of paylines that are specified for bet is less than a number of all the paylines;

(b1) change a display mode of the accumulated counted value displayed on the display when the accumulated counted value is equal to or more than a predetermined value;

(c) judge whether or not the unit game is a unit game in which all the paylines are specified for bet by an operation of the button by a player;

(d) upon judgment that the unit game is not the unit game in which all the paylines are specified for bet, prevent a process of deciding a content of an award for the progressive bonus;

(e) only upon judgment that the unit game is the unit game in which all the paylines are specified for bet, execute the process of deciding the content of the award for the progressive bonus; and (f) provide at least some of the accumulated counted value to the player as the award for the progressive bonus in the unit game in which all the paylines are specified for bet, in accordance with the decided content of the award for the progressive bonus, wherein, upon the unit games judged as the unit games in which all the paylines are specified for bet being continuously executed a predetermined number of times being greater than one, the controller is configured to execute the process of deciding the content of the award for the progressive bonus in a last unit game of the continuously executed unit games.

4. The slot machine according to claim 3, wherein, upon the accumulated counted value being equal to or more than the predetermined value, the controller is configured to judge whether or not the unit game is the unit game in which all the paylines are specified for bet.

5. A slot machine comprising:

a display configured to display a unit game causing a plurality of arranged symbols to be rearranged;

a button configured to specify at least one payline for bet for each unit game, out of a plurality of paylines set on the display, wherein each unit game is executable in a repetitive manner and each unit game requires an operation of specifying at least one payline by the button to start after a previous unit game is finished;

a counter configured to accumulate a counted value of a progressive bonus;

a value-addition mechanism by which a player is able to add to the slot machine game media to be bet;

an award payout mechanism by which game media can be paid out to the player or credited to memorized credits of the player; and a controller configured to, as a result of the player having bet game media:

(a) repeatedly execute a plurality of unit games;

(b) increment, in a unit game in which a predetermined number or more of the paylines are specified for bet, the counted value by some of an amount of bet made on the unit game in which the predetermined number or more of the paylines are specified for bet, to accumulate the counted value, and display an accumulated counted value on the display, wherein the counted value is maintained regardless of the accumulated counted value in a unit game in which a number of paylines that are specified for bet is less than the predetermined number;

(b1) change a display mode of the accumulated counted value displayed on the display when the accumulated counted value is equal to or more than a predetermined value;

(c) decide whether or not to provide an award for the progressive bonus only in a certain unit game of unit games in which the predetermined number or more of the paylines are specified for bet by an operation of the button by a player; and (d) upon decision of providing the award for the progressive bonus, provide at least some of the accumulated counted value to the player as the award for the progressive bonus in the certain unit game in which the predetermined number or more of the paylines are specified for bet, wherein, upon the unit games in which the predetermined number or more of the paylines are specified for bet being continuously executed a predetermined number of times being greater than one, the controller is configured to decide whether or not to provide the award for the progressive bonus in a last unit game of the continuously executed unit games.

6. The slot machine according to claim 5, wherein, upon the accumulated counted value being equal to or more than the predetermined value, the controller is configured to decide whether or not to provide the award for the progressive bonus in the unit game in which the predetermined number or more of the paylines are specified for bet.

7. A slot machine comprising:

a display configured to display a unit game causing a plurality of arranged symbols to be rearranged;

a button configured to specify at least one payline for bet for each unit game, out of a plurality of paylines set on the display, wherein each unit game is executable in a repetitive manner and each unit game requires an operation of specifying at least one payline by the button to start after a previous unit game is finished;

a counter configured to accumulate a counted value of a progressive bonus;

a value-addition mechanism by which a player is able to add to the slot machine game media to be bet;

an award payout mechanism by which game media can be paid out to the player or credited to memorized credits of the player; and a controller configured to, as a result of the player having bet game media:

(a) repeatedly execute a plurality of unit games in the game machine;

(b) increment, in a unit game in which a predetermined number or more of the paylines are specified for bet, the counted value by some of an amount of bet made on the unit game in which the predetermined number or more of the paylines are specified for bet, to accumulate the counted value, and display an accumulated counted value on the display, wherein the counted value is maintained regardless of the accumulated counted value in a unit game in which a number of paylines that are specified for bet is less than the predetermined number;

(b1) change a display mode of the accumulated counted value displayed on the display when the accumulated counted value is equal to or more than a predetermined value;

(c) judge whether or not the unit game is a unit game in which the predetermined number or more of the paylines are specified for bet by an operation of the button by a player;

(d) upon judgment that the unit game is not the unit game in which the predetermined number or more of the paylines are specified for bet, prevent a process of deciding a content of an award for the progressive bonus;

(e) only upon judgment that the unit game is the unit game in which the predetermined number or more of the paylines are specified for bet, execute the process of deciding the content of the award for the progressive bonus; and (f) provide at least some of the accumulated counted value to the player as the award for the progressive bonus in the unit game in which the predetermined number or more of the paylines are specified for bet, in accordance with the decided content of the award for the progressive bonus, wherein, upon the unit games judged as the unit games in which the predetermined number or more of the paylines are specified for bet being continuously executed a predetermined number of times being greater than one, the controller is configured to execute the process of deciding the content of the award for the progressive bonus in a last unit game of the continuously executed unit games.

8. The slot machine according to claim 7, wherein, upon the accumulated counted value being equal to or more than the predetermined value, the controller is configured to judge whether or not the unit game is the unit game in which the predetermined number or more of the paylines are specified for bet.

9. A method of controlling, by a controller, a slot machine configured to specify, by an operation of a button by a player, a payline for bet for each of unit games causing a plurality of arranged symbols to be rearranged, out of a plurality of paylines set on a display configured to display the unit games, the slot machine comprising a value-addition mechanism by which a player is able to add to the slot machine game media to be bet and an award payout mechanism by which game media can be paid out to the player or credited to memorized credits of the player, the method comprising, as a result of the player having bet game media:

repeatedly executing, by the controller, a plurality of unit games in the game machine;

incrementing, by the controller, in a unit game in which all the paylines are specified for bet, a counted value by some of an amount of bet made on the unit game in which all the paylines are specified for bet, to accumulate the counted value, and displaying an accumulated counted value on the display, wherein the counted value is maintained regardless of the accumulated counted value in a unit game in which a number of paylines that are specified for bet is less than a number of all the paylines;

changing, by the controller, a display mode of the accumulated counted value displayed on the display when the accumulated counted value is equal to or more than a predetermined value;

deciding, by the controller, whether or not to provide an award for a progressive bonus, only in a certain unit game of unit games in which all the paylines are specified for bet by the operation of the button by the player, wherein each unit game is executable in a repetitive manner and each unit game requires an operation of specifying at least one payline by the button to start after a previous unit game is finished; and upon decision of providing the award for the progressive bonus, providing, by the controller, at least some of the accumulated counted value to the player as the award for the progressive bonus in the unit game in which all the paylines are specified for bet, wherein the step of deciding, by the controller, whether or not to provide the award for the progressive bonus in the certain unit game in which all the paylines are specified for bet includes:

upon the unit dames in which all the paylines are specified for bet being continuously executed a predetermined number of times being greater than one, deciding, by the controller, whether or not to provide the award for the progressive bonus in a last unit game of the continuously executed unit games.

10. The method of controlling a slot machine according to claim 9, wherein the step of deciding, by the controller, whether or not to provide the award for the progressive bonus in the certain unit game in which all the paylines are specified for bet includes:

upon the accumulated counted value being equal to or more than the predetermined value, deciding, by the controller, whether or not to provide the award for the progressive bonus in the unit game in which all the paylines are specified for bet.

11. A method of controlling, by a controller, a slot machine configured to specify, by an operation of a button by a player, a payline for bet for each of unit games causing a plurality of arranged symbols to be rearranged, out of a plurality of paylines set on a display configured to display the unit games, the slot machine comprising a value-addition mechanism by which a player is able to add to the slot machine game media to be bet and an award payout mechanism by which game media can be paid out to the player or credited to memorized credits of the player, the method comprising, as a result of the player having bet game media:

repeatedly executing, by the controller, a plurality of unit games in the game machine;

incrementing, by the controller, in a unit game in which all the paylines are specified for bet, the counted value by some of an amount of bet made on the unit game in which all the paylines are specified for bet, to accumulate the counted value, and displaying an accumulated counted value on the display, wherein the counted value is maintained regardless of the accumulated counted value in a unit game in which a number of paylines that are specified for bet is less than a number of all the paylines;

changing, by the controller, a display mode of the accumulated counted value displayed on the display when the accumulated counted value is equal to or more than a predetermined value;

judging, by the controller, whether or not the unit game is a unit game in which all the paylines are specified for bet by the operation of the button by a player, wherein each unit game is executable in a repetitive manner and each unit game requires an operation of specifying at least one payline by the button to start after a previous unit game is finished;

upon judgment that the unit game is not the unit game in which all the paylines are specified for bet, preventing, by the controller, a process of deciding a content of an award for a progressive bonus;

only upon judgment that the unit game is the unit game in which all the paylines are specified for bet, executing, by the controller, the process of deciding the content of the award for the progressive bonus; and providing, by the controller, at least some of the accumulated counted value to the player as the award for the progressive bonus in the unit game in which all the paylines are specified for bet, in accordance with the decided content of the award for the progressive bonus, wherein the step of executing, by the controller, the process of deciding the content of the award for the progressive bonus only upon judgment that the unit game is the certain unit game in which all the paylines are specified for bet, includes:

upon the unit games judged as the unit games in which all the paylines are specified for bet being continuously executed a predetermined number of times being greater than one, executing, by the controller, the process of deciding the content of the award for the progressive bonus in a last unit game of the continuously executed unit games.

12. The method of controlling a slot machine according to claim 11, wherein the step of judging, by the controller, whether or not the unit game is the certain unit game in which all the paylines are specified for bet includes:

upon the accumulated counted value being equal to or more than the predetermined value, judging, by the controller, whether or not the unit game is the unit game in which all the paylines are specified for bet.

13. A method of controlling, by a controller, a slot machine configured to specify, by an operation of a button by a player, a payline for bet for each of unit games causing a plurality of arranged symbols to be rearranged, out of a plurality of paylines set on a display configured to display the unit games, the slot machine comprising a value-addition mechanism by which a player is able to add to the slot machine game media to be bet and an award payout mechanism by which game media can be paid out to the player or credited to memorized credits of the player, the method comprising, as a result of the player having bet game media:

repeatedly executing, by the controller, a plurality of unit games in the game machine;

incrementing, by the controller, in a unit game in which a predetermined number or more of the paylines are specified for bet, the counted value by some of an amount of bet made on the unit game in which the predetermined number or more of the paylines are specified for bet, to accumulate the counted value, and displaying an accumulated counted value on the display, wherein the counted value is maintained regardless of the accumulated counted value in a unit game in which a number of paylines that are specified for bet is less than the predetermined number;

changing, by the controller, a display mode of the accumulated counted value displayed on the display when the accumulated counted value is equal to or more than a predetermined value;

deciding, by the controller, whether or not to provide an award for a progressive bonus, only in a certain unit game of unit games in which the predetermined number or more of the paylines are specified for bet by the operation of the button by the player, wherein each unit game is executable in a repetitive manner and each unit game requires an operation of specifying at least one payline by the button to start after a previous unit game is finished; and upon decision of providing the award for the progressive bonus, providing, by the controller, at least some of the accumulated counted value to the player as the award for the progressive bonus in the unit game in which the predetermined number or more of the paylines are specified for bet, wherein the step of deciding, by the controller, whether or not to provide the award for the progressive bonus in the certain unit game in which the predetermined number or more of the paylines are specified for bet includes:

upon the unit games in which the predetermined number or more of the paylines are specified for bet being continuously executed a predetermined number of times being greater than one, deciding, by the controller, whether or not to provide the award for the progressive bonus in a last unit game of the continuously executed unit games.

14. The method of controlling a slot machine according to claim 13, wherein the step of deciding, by the controller, whether or not to provide the award for the progressive bonus in the certain unit game in which the predetermined number or more of the paylines are specified for bet includes:

upon the accumulated counted value being equal to or more than the predetermined value, deciding, by the controller, whether or not to provide the award for the progressive bonus in the unit game in which the predetermined number or more of the paylines are specified for bet.

15. A method of controlling, by a controller, a slot machine configured to specify, by an operation of a button by a player, a payline for bet for each of unit games causing a plurality of arranged symbols to be rearranged, out of a plurality of paylines set on a display configured to display the unit games, the slot machine comprising a value-addition mechanism by which a player is able to add to the slot machine game media to be bet and an award payout mechanism by which game media can be paid out to the player or credited to memorized credits of the player, the method comprising, as a result of the player having bet game media:

repeatedly executing, by the controller, a plurality of unit games in the game machine;

incrementing, by the controller, in a unit game in which a predetermined number or more of the paylines are specified for bet, the counted value by some of an amount of bet made on the unit game in which the predetermined number or more of the paylines are specified for bet, to accumulate the counted value, and displaying an accumulated counted value on the display, wherein the counted value is maintained regardless of the accumulated counted value in a unit game in which a number of paylines that are specified for bet is less than the predetermined number;

changing, by the controller, a display mode of the accumulated counted value displayed on the display when the accumulated counted value is equal to or more than a predetermined value;

judging, by the controller, whether or not the unit game is a unit game in which the predetermined number or more of the paylines are specified for bet by the operation of the button by the player, wherein each unit game is executable in a repetitive manner and each unit game requires an operation of specifying at least one payline by the button to start after a previous unit game is finished;

upon judgment that the unit game is not the unit game in which the predetermined number or more of the paylines are specified for bet, preventing, by the controller, a process of deciding a content of an award for a progressive bonus;

only upon judgment that the unit game is the unit game in which the predetermined number or more of the paylines are specified for bet, executing, by the controller, the process of deciding the content of the award for the progressive bonus; and providing, by the controller, at least some of the accumulated counted value to the player as the award for the progressive bonus in the unit game in which the predetermined number or more of the paylines are specified for bet, in accordance with the decided content of the award for the progressive bonus, wherein the step of executing, by the controller, the process of deciding the content of the award for the progressive bonus upon judgment that the unit game is the certain unit game in which the predetermined number or more of the paylines are specified for bet includes:

upon the unit games in which the predetermined number or more of the paylines are specified for bet being continuously executed a predetermined number of times being greater than one, executing, by the controller, the process of deciding the content of the award for the progressive bonus in a last unit game of the continuously executed unit games.

16. The method of controlling a slot machine according to claim 15, wherein the step of judging, by the controller, whether or not the unit game is the certain unit game in which the predetermined number or more of the paylines are specified for bet includes:

upon the accumulated counted value being equal to or more than the predetermined value, judging, by the controller, whether or not the unit game is the unit game in which the predetermined number or more of the paylines are specified for bet.

17. The slot machine according to claim 1, wherein the display mode includes a display color.

18. The slot machine according to claim 3, wherein the display mode includes a display color.

19. The slot machine according to claim 5, wherein the display mode includes a display color.

20. The slot machine according to claim 7, wherein the display mode includes a display color.

21. The method of controlling a slot machine according to claim 9, wherein the display mode includes a display color.

22. The method of controlling a slot machine according to claim 11, wherein the display mode includes a display color.

23. The method of controlling a slot machine according to claim 13, wherein the display mode includes a display color.

24. The method of controlling a slot machine according to claim 15, wherein the display mode includes a display color.

* * * * *